US011624534B2

(12) United States Patent
Clodic et al.

(10) Patent No.: US 11,624,534 B2
(45) Date of Patent: Apr. 11, 2023

(54) METHOD FOR EXCHANGING HEAT IN VAPOR COMPRESSION HEAT TRANSFER SYSTEMS AND VAPOR COMPRESSION HEAT TRANSFER SYSTEMS COMPRISING INTERMEDIATE HEAT EXCHANGERS WITH DUAL-ROW EVAPORATORS OR CONDENSERS

(71) Applicant: THE CHEMOURS COMPANY FC, LLC, Wilmington, DE (US)

(72) Inventors: Denis Clodic, Palaiseau (FR); Youssef Riachi, El Kenchara (LB); Mary E. Koban, Chadds Ford, PA (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 0 days.

(21) Appl. No.: 15/939,644

(22) Filed: Mar. 29, 2018

(65) Prior Publication Data

US 2018/0231281 A1 Aug. 16, 2018

Related U.S. Application Data

(63) Continuation of application No. 13/207,557, filed on Aug. 11, 2011, now abandoned, which is a (Continued)

(51) Int. Cl.
*F25B 40/02* (2006.01)
*F25B 40/00* (2006.01)
(Continued)

(52) U.S. Cl.
CPC ..... *F25B 40/02* (2013.01); *F25B 40/00* (2013.01); *F25B 49/027* (2013.01);
(Continued)

(58) Field of Classification Search
CPC ..... F28D 1/05333; F25B 40/00; F25B 40/02
See application file for complete search history.

(56) References Cited

U.S. PATENT DOCUMENTS 2,120,764 A 6/1938 Newton
3,877,242 A 4/1975 Creager
(Continued)

FOREIGN PATENT DOCUMENTS

DE 198 43 928 A1 4/1999
EP 1 142 742 A 10/2001
(Continued)

OTHER PUBLICATIONS

PCT Partial International Search Report dated Dec. 12, 2008.
(Continued)

*Primary Examiner* — Brian M King

(57) ABSTRACT

A multi-step method is disclosed for exchanging heat in a vapor compression heat transfer system having a working fluid circulating therethrough. The method includes the step of circulating a working fluid comprising a fluoroolefin to an inlet of a first tube of an internal heat exchanger, through the internal heat exchanger and to an outlet thereof. Also disclosed are vapor compression heat transfer systems for exchanging heat. The systems include an evaporator, a compressor, a dual-row condenser and an intermediate heat exchanger having a first tube and a second tube. A disclosed system involves a dual-row condenser connected to the first and second intermediate heat exchanger tubes. Another disclosed system involves a dual-row evaporator connected to the first and second intermediate heat exchanger tubes.

10 Claims, 2 Drawing Sheets

Related U.S. Application Data continuation-in-part of application No. 12/119,023, filed on May 12, 2008, now abandoned.

(60) Provisional application No. 60/988,562, filed on Nov. 16, 2007, provisional application No. 60/928,826, filed on May 11, 2007.

(51) Int. Cl.

| | |
|---|---|
| ***F28D 1/053*** | (2006.01) |
| ***F28D 1/04*** | (2006.01) |
| ***F25B 49/02*** | (2006.01) |
| *F28D 21/00* | (2006.01) |

(52) U.S. Cl.

CPC ..... *F28D 1/0452* (2013.01); *F28D 1/05333* (2013.01); *F28D 1/05383* (2013.01); *F28D 1/05391* (2013.01); *F25B 2339/046* (2013.01); *F25B 2400/121* (2013.01); *F28D 2021/007* (2013.01); *F28D 2021/0071* (2013.01)

(56) References Cited

U.S. PATENT DOCUMENTS

| | | | | |
|---|---|---|---|---|
| 4,230,470 | A | 10/1980 | Matsuda et al. | |
| 4,316,366 | A | 2/1982 | Manning | |
| 4,774,813 | A | 10/1988 | Yokoyama | |
| 5,271,473 | A | 12/1993 | Ikeda et al. | |
| 5,529,116 | A | 6/1996 | Sasaki et al. | |
| 5,987,907 | A | 11/1999 | Morimoto et al. | |
| 6,021,846 | A * | 2/2000 | Sasaki | F28D 1/0417 165/144 |
| 6,176,102 | B1 | 1/2001 | Novak et al. | |
| 6,327,866 | B1 | 12/2001 | Novak et al. | |
| 6,564,567 | B2 | 5/2003 | Skupin et al. | |
| 7,448,228 | B2 | 11/2008 | Han | |
| 7,448,436 | B2 | 11/2008 | Katoh et al. | |
| 2004/0206490 | A1 | 10/2004 | Kotoh et al. | |
| 2004/0244411 | A1 * | 12/2004 | Ichimura | B60H 1/00571 62/513 |
| 2005/0011637 | A1 | 1/2005 | Takano | |
| 2005/0050910 | A1 | 3/2005 | Moon et al. | |
| 2006/0022166 | A1 | 2/2006 | Wilson et al. | |
| 2006/0032244 | A1 * | 2/2006 | Tomlinson | F24F 3/153 62/115 |
| 2006/0243944 | A1 * | 11/2006 | Minor | A62D 1/0057 252/67 |
| 2006/0243945 | A1 | 11/2006 | Minor et al. | |
| 2007/0062678 | A1 | 3/2007 | Hayashi et al. | |
| 2007/0100175 | A1 | 5/2007 | Miller et al. | |
| 2007/0108403 | A1 | 5/2007 | Sievert et al. | |
| 2008/0230738 | A1 | 9/2008 | Minor et al. | |
| 2009/0314015 | A1 | 12/2009 | Minor et al. | |
| 2010/0012302 | A1 | 1/2010 | Clodic et al. | |

FOREIGN PATENT DOCUMENTS

| | | | |
|---|---|---|---|
| EP | 1 764 574 | A | 3/2007 |
| GB | 2 405 688 | A | 3/2005 |
| JP | 10-019418 | A | 1/1998 |
| JP | 2001-263831 | A | 9/2001 |
| JP | 2003021432 | A | 1/2003 |
| JP | 2006-183889 | A | 7/2006 |
| WO | 2002/025179 | A1 | 3/2002 |
| WO | 2004/037913 | A2 | 5/2004 |
| WO | 2005/042663 | A1 | 5/2005 |
| WO | 2007/053736 | A | 5/2007 |
| WO | 2008/027555 | A2 | 3/2008 |

OTHER PUBLICATIONS

PCT International Search Report dated Mar. 10, 2009.

Jeanneaux et al., Journal of Fluorine Chemistry, vol. 4, pp. 261-270, 1974.

PCT International Search Report dated Jul. 23, 2008 for International Application No. PCT/US2007/025675.

Barbara Minor et al., HFO-1234yf Low GWP Refrigerant Update, International Refrigeration and Air Conditioning Conference at Purdue, Jul. 14-17, 2008, pp. 1-8.

Barbara Minor et al., HFO-1234yf Performance in a Beverage Cooler, International Refrigeration and Air Conditioning Conference at Purdue, Jul. 12-15, 2010, pp. 1-6.

Bukola O. Bolaji, Theoretical analysis of the energy performance of three low global warming potential hydro-fluorocarbon refrigerants as R134a alternatives in refrigeration systems, Journal of Power and Energy 2014, pp. 56-63, vol. 228(1), Sage Publications Ltd.—Abstract Only.

McLinden, et al., Limited options for low-global-warming-potential refrigerants, Nature Communications, Jul. 1, 2016.

Pham et al., Lower-GWP Refrigerants in Refrigeration, 2012 ASHRAE/NIST Refrigerants Conference, 2012.

Hickman, Kenneth E Alternatives to High Gwp HFC Refrigerants: Chiller Applications, 2012 ASHRAE/NIST Refrigerants Conference, 2012.

* cited by examiner

METHOD FOR EXCHANGING HEAT IN VAPOR COMPRESSION HEAT TRANSFER SYSTEMS AND VAPOR COMPRESSION HEAT TRANSFER SYSTEMS COMPRISING INTERMEDIATE HEAT EXCHANGERS WITH DUAL-ROW EVAPORATORS OR CONDENSERS

CROSS REFERENCE TO RELATED APPLICATIONS

This application is a continuation of and claims the priority benefit of pending U.S. patent application Ser. No. 13/207,557, filed Aug. 11, 2011, which is a continuation-in-part of and claims the priority benefit of U.S. patent application Ser. No. 12/119,023, filed May 12, 2008, which claims the priority benefit of U.S. Provisional Application No. 60/928,826, filed May 11, 2007, U.S. Provisional Application No. 60/988,562, filed Nov. 16, 2007 and PCT Application No. PCT/US2007/025675, filed Dec. 17, 2007.

BACKGROUND OF THE INVENTION

1. Field of the Invention

The present disclosure relates to a method for exchanging heat in a vapor compression heat transfer system. In particular, it relates to use of an intermediate heat exchanger to improve performance of a vapor compression heat transfer system utilizing a working fluid comprising at least one fluoroolefin.

2. Description of Related Art

Methods for improving the performance of heat transfer systems, such as refrigeration systems and air conditioners, are always being sought, in order to reduce cost of operation of such systems.

When new working fluids for heat transfer systems, including vapor compression heat transfer systems, are being proposed it is important to be able to provide means of improving cooling capacity and energy efficiency for the new working fluids.

SUMMARY OF THE INVENTION

Applicants have found that the use of an internal heat exchanger in a vapor compression heat transfer system that uses a fluoroolefin provides unexpected benefits due to sub-cooling of the working fluid exiting out of the condenser. By "subcooling" is meant the reduction of the temperature of a liquid below that liquid's saturation point for a given pressure. The saturation point is the temperature at which the vapor usually would condense to a liquid, but subcooling produces a lower temperature vapor at the given pressure. By cooling a vapor below the saturation point, the net refrigeration capacity can be increased. Sub-cooling thereby improves cooling capacity and energy efficiency of a system, such as vapor compression heat transfer systems, which comprise fluoroolefins.

In particular, when the fluoroolefin 2,3,3,3-tetrafluoropropene (HFC-1234yf) is used as the working fluid, surprising results have been achieved with respect to coefficient of performance and capacity of the working fluid, as compared to the use of known working fluids such as 1,1,1,2-tetrafluoroethane (HFC-124a).

Therefore, in accordance with the present invention, the present disclosure provides a method of exchanging heat in a vapor compression heat transfer system, comprising:

(a) circulating a working fluid comprising a fluoroolefin to an inlet of a first tube of an internal heat exchanger, through the internal heat exchanger and to an outlet thereof;

(b) circulating the working fluid from the outlet of the first tube of the internal heat exchanger to an inlet of an evaporator, through the evaporator to evaporate the working fluid into a gas, and through an outlet of the evaporator;

(c) circulating the working fluid from the outlet of the evaporator to an inlet of a second tube of the internal heat exchanger to transfer heat from the liquid working fluid from the condenser to the gaseous working fluid from the evaporator, through the internal heat exchanger, and to an outlet of the second tube;

(d) circulating the working fluid from the outlet of the second tube of the internal heat exchanger to an inlet of a compressor, through the compressor to compress the working fluid gas, and to an outlet of the compressor;

(e) circulating the working fluid from the outlet of the compressor to an inlet of a condenser and through the condenser to condense the compressed working fluid gas into a liquid, and to an outlet of the condenser;

(f) circulating the working fluid from the outlet of the condenser to an inlet of the first tube of the intermediate heat exchanger to transfer heat from the liquid from the condenser to the gas from the evaporator, and to an outlet of the second tube; and (g) circulating the working fluid from the outlet of the second tube of the internal heat exchanger back to the evaporator.

The fluorolefin is a compound selected from the group consisting of:

(i) fluoroolefins of the formula E- or Z—$R^1CH{=}CHR^2$, wherein $R^1$ and $R^2$ are, independently, $C_1$ to $C_6$ perfluoroalkyl groups;

(ii) cyclic fluoroolefins of the formula cyclo-[CX=CY$(CZW)_n$—], wherein X, Y, Z, and W, independently, are H or F, and n is an integer from 2 to 5; and (iii) fluoroolefins selected from the group consisting of: 1,2,3,3,3-pentafluoro-1-propene ($CHF{=}CFCF_3$), 1,1,3,3,3-pentafluoro-1-propene ($CF_2{=}CHCF_3$), 1,1,2,3,3-pentafluoro-1-propene ($CF_2{=}CFCHF_2$), 1,2,3,3-tetrafluoro-1-propene ($CHF{=}CFCHF_2$), 2,3,3,3-tetrafluoro-1-propene ($CH_2{=}CFCF_3$), 1,3,3,3-tetrafluoro-1-propene ($CHF{=}CHCF_3$), 1,1,2,3-tetrafluoro-1-propene ($CF_2{=}CFCH_2F$), 1,1,3,3-tetrafluoro-1-propene ($CF_2{=}CHCHF_2$), 1,2,3,3-tetrafluoro-1-propene ($CHF{=}CFCHF_2$), 3,3,3-trifluoro-1-propene ($CH_2{=}CHCF_3$), 2,3,3-trifluoro-1-propene ($CHF_2CF{=}CH_2$); 1,1,2-trifluoro-1-propene ($CH_3CF{=}CF_2$); 1,2,3-trifluoro-1-propene ($CH_2FCF{=}CF_2$); 1,1,3-trifluoro-1-propene ($CH_2FCH{=}CF_2$); 1,3,3-trifluoro-1-propene ($CHF_2CH{=}CHF$); 1,1,1,2,3,4,4,4-octafluoro-2-butene ($CF_3CF{=}CFCF_3$); 1,1,2,3,3,4,4,4-octafluoro-1-butene ($CF_3CF_2CF{=}CF_2$); 1,1,1,2,4,4,4-heptafluoro-2-butene ($CF_3CF{=}CHCF_3$); 1,2,3,3,4,4,4-heptafluoro-1-butene ($CHF{=}CFCF_2CF_3$); 1,1,1,2,3,4,4-heptafluoro-2-butene ($CHF_2CF{=}CFCF_3$); 1,3,3,3-tetrafluoro-2-(trifluoromethyl)-1-propene ($(CF_3)_2C{=}CHF$); 1,1,3,3,4,4,4-heptafluoro-1-butene ($CF_2{=}CHCF_2CF_3$); 1,1,2,3,4,4,4-heptafluoro-1-butene ($CF_2{=}CFCHFCF_3$); 1,1,2,3,3,4, 4-heptafluoro-1-butene ($CF_2{=}CFCF_2CHF_2$); 2,3,3,4,4,4-hexafluoro-1-butene ($CF_3CF_2CF{=}CH_2$); 1,3,3,4,4,4-hexafluoro-1-butene ($CHF{=}CHCF_2CF_3$); 1,2,3,4,4,4-hexafluoro-1-butene ($CHF{=}CFCHFCF_3$); 1,2,3,3,4,4-hexafluoro-1-butene ($CHF{=}CFCF_2CHF_2$); 1,1,2,3,4,4-hexafluoro-2-butene ($CHF_2CF{=}CFCHF_2$); 1,1,1,2,3,4-hexafluoro-2-butene ($CH_2FCF{=}CFCF_3$); 1,1,1,2,4,4-hexafluoro-2-butene ($CHF_2CH{=}CFCF_3$); 1,1,1,3,4,4-hexafluoro-2-butene ($CF_3CH{=}CFCHF_2$); 1,1,2,3,3,4-hexafluoro-1-butene ($CF_2{=}CFCF_2CH_2F$); 1,1,2,3,4,4-hexafluoro-1-butene ($CF_2{=}CFCHFCHF_2$); 3,3,3-trifluoro-2-(trifluoromethyl)-1-propene ($CH_2{=}C(CF_3)_2$); 1,1,1,2,4-pentafluoro-2-butene ($CH_2FCH{=}CFCF_3$); 1,1,1,3,4-pentafluoro-2-butene ($CF_3CH{=}CFCH_2F$); 3,3,4,4,4-pentafluoro-1-butene ($CF_3CF_2CH{=}CH_2$); 1,1,1,4,4-pentafluoro-2-butene ($CHF_2CH{=}CHCF_3$); 1,1,1,2,3-pentafluoro-2-butene ($CH_3CF{=}CFCF_3$); 2,3,3,4,4-pentafluoro-1-butene ($CH_2{=}CFCF_2CHF_2$); 1,1,2,4,4-pentafluoro-2-butene ($CHF_2CF{=}CHCHF_2$); 1,1,2,3,3-pentafluoro-1-butene ($CH_3CF_2CF{=}CF_2$); 1,1,2,3,4-pentafluoro-2-butene ($CH_2FCF{=}CFCHF_2$); 1,1,3,3,3-pentafluoro-2-methyl-1-propene ($CF_2{=}C(CF_3)(CH_3)$); 2-(difluoromethyl)-3,3,3-trifluoro-1-propene ($CH_2{=}C(CHF_2)(CF_3)$); 2,3,4,4,4-pentafluoro-1-butene ($CH_2{=}CFCHFCF_3$); 1,2,4,4,4-pentafluoro-1-butene ($CHF{=}CFCH_2CF_3$); 1,3,4,4,4-pentafluoro-1-butene ($CHF{=}CHCHFCF_3$); 1,3,3,4,4-pentafluoro-1-butene ($CHF{=}CHCF_2CHF_2$); 1,2,3,4,4-pentafluoro-1-butene ($CHF{=}CFCHFCHF_2$); 3,3,4,4-tetrafluoro-1-butene ($CH_2{=}CHCF_2CHF_2$); 1,1-difluoro-2-(difluoromethyl)-1-propene ($CF_2{=}C(CHF_2)(CH_3)$); 1,3,3,3-tetrafluoro-2-methyl-1-propene ($CHF{=}C(CF_3)(CH_3)$); 3,3-difluoro-2-(difluoromethyl)-1-propene ($CH_2{=}C(CHF_2)_2$); 1,1,1,2-tetrafluoro-2-butene ($CF_3CF{=}CHCH_3$); 1,1,1,3-tetrafluoro-2-butene ($CH_3CF{=}CHCF_3$); 1,1,1,2,3,4,4,5,5,5-decafluoro-2-pentene ($CF_3CF{=}CFCF_2CF_3$); 1,1,2,3,3,4,4,5,5,5-decafluoro-1-pentene ($CF_2{=}CFCF_2CF_2CF_3$); 1,1,1,4,4,4-hexafluoro-2-(trifluoromethyl)-2-butene ($(CF_3)_2C{=}CHCF_3$); 1,1,1,2,4,4,5,5,5-nonafluoro-2-pentene ($CF_3CF{=}CHCF_2CF_3$); 1,1,1,3,4,4,5,5,5-nonafluoro-2-pentene ($CF_3CH{=}CFCF_2CF_3$); 1,2,3,3,4,4,5,5,5-nonafluoro-1-pentene ($CHF{=}CFCF_2CF_2CF_3$); 1,1,3,3,4,4,5,5,5-nonafluoro-1-pentene ($CF_2{=}CHCF_2CF_2CF_3$); 1,1,2,3,3,4,4,5,5-nonafluoro-1-pentene ($CF_2{=}CFCF_2CF_2CHF_2$); 1,1,2,3,4,4,5,5,5-nonafluoro-2-pentene ($CHF_2CF{=}CFCF_2CF_3$); 1,1,1,2,3,4,4,5,5-nonafluoro-2-pentene ($CF_3CF{=}CFCF_2CHF_2$); 1,1,1,2,3,4,5,5,5-nonafluoro-2-pentene ($CF_3CF{=}CFCHFCF_3$); 1,2,3,4,4,4-hexafluoro-3-(trifluoromethyl)-1-butene ($CHF{=}CFCF(CF_3)_2$); 1,1,2,4,4,4-hexafluoro-3-(trifluoromethyl)-1-butene ($CF_2{=}CFCH(CF_3)_2$); 1,1,1,4,4,4-hexafluoro-2-(trifluoromethyl)-2-butene ($CF_3CH{=}C(CF_3)_2$); 1,1,3,4,4,4-hexafluoro-3-(trifluoromethyl)-1-butene ($CF_2{=}CHCF(CF_3)_2$); 2,3,3,4,4,5,5,5-octafluoro-1-pentene ($CH_2{=}CFCF_2CF_2CF_3$); 1,2,3,3,4,4,5,5-octafluoro-1-pentene ($CHF{=}CFCF_2CF_2CHF_2$); 3,3,4,4,4-pentafluoro-2-(trifluoromethyl)-1-butene ($CH_2{=}C(CF_3)CF_2CF_3$); 1,1,4,4,4-pentafluoro-3-(trifluoromethyl)-1-butene ($CF_2{=}CHCH(CF_3)_2$); 1,3,4,4,4-pentafluoro-3-(trifluoromethyl)-1-butene ($CHF{=}CHCF(CF_3)_2$); 1,1,4,4,4-pentafluoro-2-(trifluoromethyl)-1-butene ($CF_2{=}C(CF_3)CH_2CF_3$); 3,4,4,4-tetrafluoro-3-(trifluoromethyl)-1-butene ($(CF_3)_2CFCH{=}CH_2$); 3,3,4,4,5,5,5-heptafluoro-1-pentene ($CF_3CF_2CF_2CH{=}CH_2$); 2,3,3,4,4,5,5-heptafluoro-1-pentene ($CH_2{=}CFCF_2CF_2CHF_2$); 1,1,3,3,5,5,5-heptafluoro-1-butene ($CF_2{=}CHCF_2CH_2CF_3$); 1,1,1,2,4,4,4-heptafluoro-3-methyl-2-butene ($CF_3CF{=}C(CF_3)(CH_3)$); 2,4,4,4-tetrafluoro-3-(trifluoromethyl)-1-butene ($CH_2{=}CFCH(CF_3)_2$); 1,4,4,4-tetrafluoro-3-(trifluoromethyl)-1-butene ($CHF{=}CHCH(CF_3)_2$); 1,1,1,4-tetrafluoro-2-(trifluoromethyl)-2-butene ($CH_2FCH{=}C(CF_3)_2$); 1,1,1,3-tetrafluoro-2-(trifluoromethyl)-2-butene ($CH_3CF{=}C(CF_3)_2$); 1,1,1-trifluoro-2-(trifluoromethyl)-2-butene ($(CF_3)_2C{=}CHCH_3$); 3,4,4,5,5,5-hexafluoro-2-pentene ($CF_3CF_2CF{=}CHCH_3$); 1,1,1,4,4,4-hexafluoro-2-methyl-2-butene ($CF_3C(CH_3){=}CHCF_3$); 3,3,4,5,5,5-hexafluoro-1-pentene ($CH_2{=}CHCF_2CHFCF_3$); 4,4,4-trifluoro-2-(trifluoromethyl)-1-butene ($CH_2{=}C(CF_3)CH_2CF_3$); 1,1,2,3,3,4,4,5,5,6,6,6-dodecafluoro-1-hexene ($CF_3(CF_2)_3CF{=}CF_2$); 1,1,1,2,2,3,4,5,5,6,6,6-dodecafluoro-3-hexene ($CF_3CF_2CF{=}CFCF_2CF_3$); 1,1,1,4,4,4-hexafluoro-2,3-bis(trifluoromethyl)-2-butene ($(CF_3)_2C{=}C(CF_3)_2$); 1,1,1,2,3,4,5,5,5-nonafluoro-4-(trifluoromethyl)-2-pentene ($(CF_3)_2CFCF{=}CFCF_3$); 1,1,1,4,4,5,5,5-octafluoro-2-(trifluoromethyl)-2-pentene ($(CF_3)_2C{=}CHC_2F_5$); 1,1,1,3,4,5,5,5-octafluoro-4-(trifluoromethyl)-2-pentene ($(CF_3)_2FCCF{=}CHCF_3$); 3,3,4,4,5,5,6,6,6-nonafluoro-1-hexene ($CF_3CF_2CF_2CF_2CH{=}CH_2$); 4,4,4-trifluoro-3,3-bis(trifluoromethyl)-1-butene ($CH_2{=}CHC(CF_3)_3$); 1,1,1,4,4,4-hexafluoro-3-methyl-2-(trifluoromethyl)-2-butene ($(CF_3)_2C{=}C(CH_3)(CF_3)$); 2,3,3,5,5,5-hexafluoro-4-(trifluoromethyl)-1-pentene ($CH_2{=}CFCF_2CH(CF_3)_2$); 1,1,1,2,4,4,5,5,5-nonafluoro-3-methyl-2-pentene ($CF_3CF{=}C(CH_3)CF_2CF_3$); 1,1,1,5,5,5-hexafluoro-4-(trifluoromethyl)-2-pentene ($CF_3CH{=}CHCH(CF_3)_2$); 3,4,4,5,5,6,6,6-octafluoro-2-hexene ($CF_3CF_2CF_2CF{=}CHCH_3$); 3,3,4,4,5,5,6,6-octafluoro1-hexene ($CH_2{=}CHCF_2CF_2CF_2CHF_2$); 1,1,1,4,4-pentafluoro-2-(trifluoromethyl)-2-pentene ($(CF_3)_2C{=}CHCF_2CH_3$); 4,4,5,5,5-pentafluoro-2-(trifluoromethyl)-1-pentene ($CH_2{=}C(CF_3)CH_2C_2F_5$); 3,3,4,4,5,5,5-heptafluoro-2-methyl-1-pentene ($CF_3CF_2CF_2C(CH_3){=}CH_2$); 4,4,5,5,6,6,6-heptafluoro-2-hexene ($CF_3CF_2CF_2CH{=}CHCH_3$); 4,4,5,5,6,6,6-heptafluoro-1-hexene ($CH_2{=}CHCH_2CF_2C_2F_5$); 1,1,1,2,2,3,4-heptafluoro-3-hexene ($CF_3CF_2CF{=}CFC_2H_5$); 4,5,5,5-tetrafluoro-4-(trifluoromethyl)-1-pentene ($CH_2{=}CHCH_2CF(CF_3)_2$); 1,1,1,2,5,5,5-heptafluoro-4-methyl-2-pentene ($CF_3CF{=}CHCH(CF_3)(CH_3)$); 1,1,1,3-tetrafluoro-2-(trifluoromethyl)-2-pentene ($(CF_3)_2C{=}CFC_2H_5$); 1,1,1,2,3,4,4,5,5,6,6,7,7,7-tetradecafluoro-2-heptene ($CF_3CF{=}CCF_2CF_2C_2F_5$); 1,1,1,2,2,3,4,5,5,6,6,7,7,7-tetradecafluoro-3-heptene ($CF_3CF_2CF{=}CFCF_2C_2F_5$); 1,1,1,3,4,4,5,5,6,6,7,7,7-tridecafluoro-2-heptene ($CF_3CH{=}CFCF_2CF_2C_2F_5$); 1,1,1,2,4,4,5,5,6,6,7,7,7-tridecafluoro-2-heptene ($CF_3CF{=}CHCF_2CF_2C_2F_5$); 1,1,1,2,2,4,5,5,6,6,7,7,7-tridecafluoro-3-heptene ($CF_3CF_2CH{=}CFCF_2C_2F_5$); 1,1,1,2,2,3,5,5,6,6,7,7,7-tridecafluoro-3-heptene ($CF_3CF_2CF{=}CHCF_2C_2F_5$); pentafluoroethyl trifluorovinyl ether ($CF_2{=}CFOCF_2CF_3$); and trifluoromethyl trifluorovinyl ether ($CF_2{=}CFOCF_3$).

In addition, sub-cooling has been found to enhance the performance and efficiency of systems which use cross-current/counter-current heat exchange, such as those which employ either a dual-row condenser or a dual-row evaporator.

Therefore, further in accordance with the method of the present invention, the present disclosure also provides that the condensing step may comprise:

(i) circulating the working fluid to a back row of the dual-row condenser, where the back row receives the working fluid at a first temperature; and (ii) circulating the working fluid to a front row of the dual-row condenser, where the front row receives the working fluid at a second temperature, where the second temperature is less than the first temperature, so that air which travels across the front row and the back row is preheated, whereby the temperature of the air is greater when it reaches the back row than when it reaches the front row.

Further in accordance with the method of the present invention, the present disclosure also provides that the evaporating step may comprise:

(i) passing the working fluid through an inlet of a dual-row evaporator having a first row and a second row, (ii) circulating the working fluid in a first row in a direction perpendicular to the flow of fluid through the inlet of the evaporator, and (iii) circulating the working fluid in a second row in a direction generally counter to the direction of the flow of the working fluid through the inlet.

Also in accordance with the present invention, there is provided a vapor compression heat transfer system for exchanging heat comprising an intermediate heat exchanger in combination with a dual-row condenser or a dual-row evaporator, or both.

BRIEF DESCRIPTION OF THE DRAWINGS

The present invention may be better understood with reference to the following figures, wherein.

DETAILED DESCRIPTION OF THE INVENTION

Figure 1A:
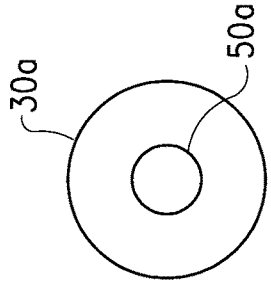
FIG. 1A is a cross-sectional view of one embodiment of an intermediate heat exchanger.
Figure 1:
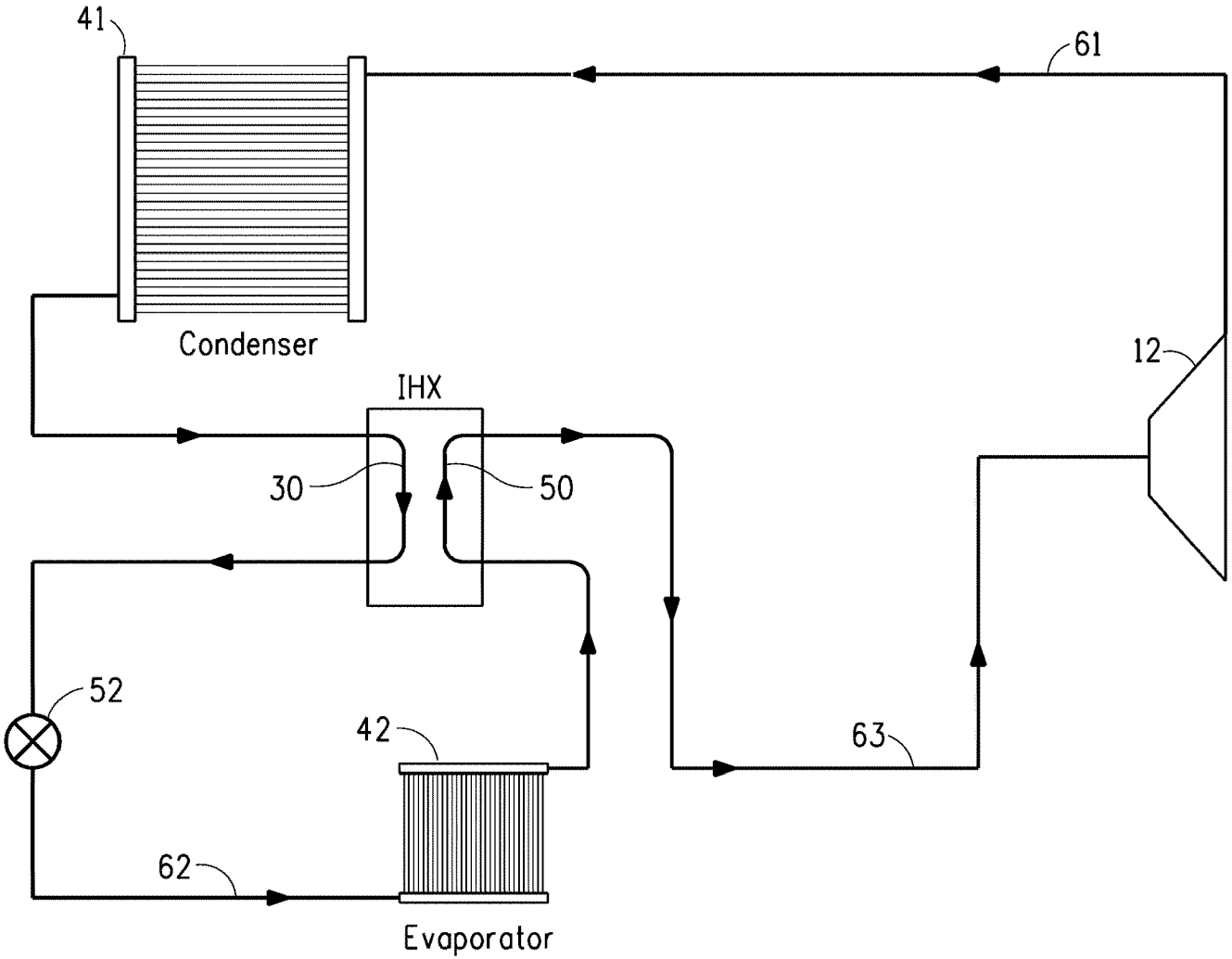
FIG. 1 is a schematic diagram of one embodiment of a vapor compression heat transfer system including an intermediate heat exchanger, used to practice the method of circulating a working fluid comprising a fluoroolefin through this system according to the present invention.

One embodiment of the present disclosure provides a method of circulating a working fluid comprising a fluoroolefin through a vapor compression heat transfer system. A vapor-compression heat transfer system is a closed loop system which re-uses working fluid in multiple steps producing a cooling effect in one step and a heating effect in a different step. Such a system generally includes an evaporator, a compressor, a condenser and an expansion device, and is known in the art. Reference will be made to FIG. 1 in describing this method.

With reference to FIG. 1, liquid working fluid from a condenser 41 flows through a line to an intermediate heat exchanger, or simply IHX. The intermediate heat exchanger includes a first tube 30, which contains a relatively hot liquid working fluid, and a second tube 50, which contains a relatively colder gaseous working fluid. The first tube of the IHX is connected to the outlet line of the condenser. The liquid working fluid then flows through an expansion device 52 and through a line 62 to an evaporator 42, which is located in the vicinity of a body to cooled. In the evaporator, the working fluid is evaporated, and the vaporization of the working fluid provides cooling. The expansion device 52 may be an expansion valve, a capillary tube, an orifice tube or any other device where the working fluid may undergo an abrupt reduction in pressure. The evaporator has an outlet, through which the cold gaseous working fluid flows to the second tube 50 of the IHX, wherein the cold gaseous working fluid comes in thermal contact with the hot liquid working fluid in the first tube 30 of the IHX, and thus the cold gaseous working fluid is warmed somewhat. The gaseous working fluid flows from the second tube of the IHX through a line 63 to the inlet of a compressor 12. The gas is compressed in the compressor, and the compressed gaseous working fluid is discharged from the compressor and flows to the condenser 41 through a line 61 wherein the working fluid is condensed, thus giving off heat, and the cycle then repeats.

In an intermediate heat exchanger, the first tube containing the relatively hotter liquid working fluid and the second tube containing the relatively colder gaseous working fluid are in thermal contact, thus allowing transfer of heat from the hot liquid to the cold gas. The means by which the two tubes are in thermal contact may vary. In one embodiment, the first tube has a larger diameter than the second tube, and the second tube is disposed concentrically in the first tube, and a hot liquid in the first tube surrounds a cold gas in the second tube. This embodiment is shown in FIG. 1A, where the first tube (30*a*) surrounds the second tube (50*a*).

Also, in one embodiment, the working fluid in the second tube of the internal heat exchanger may flow in a counter-current direction to the direction of flow of the working fluid in the first tube, thereby cooling the working fluid in the first tube and heating the working fluid in the second tube.

Cross-current/counter-current heat exchange may be provided in the system of FIG. 1 by a dual-row condenser or a dual-row evaporator, although it should be noted that this system is not limited to such a dual-row condensers or evaporators. Such condensers and evaporators are described in detail in U.S. Provisional Patent Application No. 60/875,982, filed Dec. 19, 2006 (now International Application PCT/US07/25675, filed Dec. 17, 2007), and may be designed particularly for working fluids that comprise non-azeotropic or near-azeotropic compositions.

Therefore, in accordance with the present invention, there is provided a vapor compression heat transfer system which comprises either a dual-row condenser, or a dual-row evaporator, or both. Such a system is the same as that described above with respect to FIG. 1, except for the description of the dual-row condenser or the dual-row evaporator.

Figure 2:
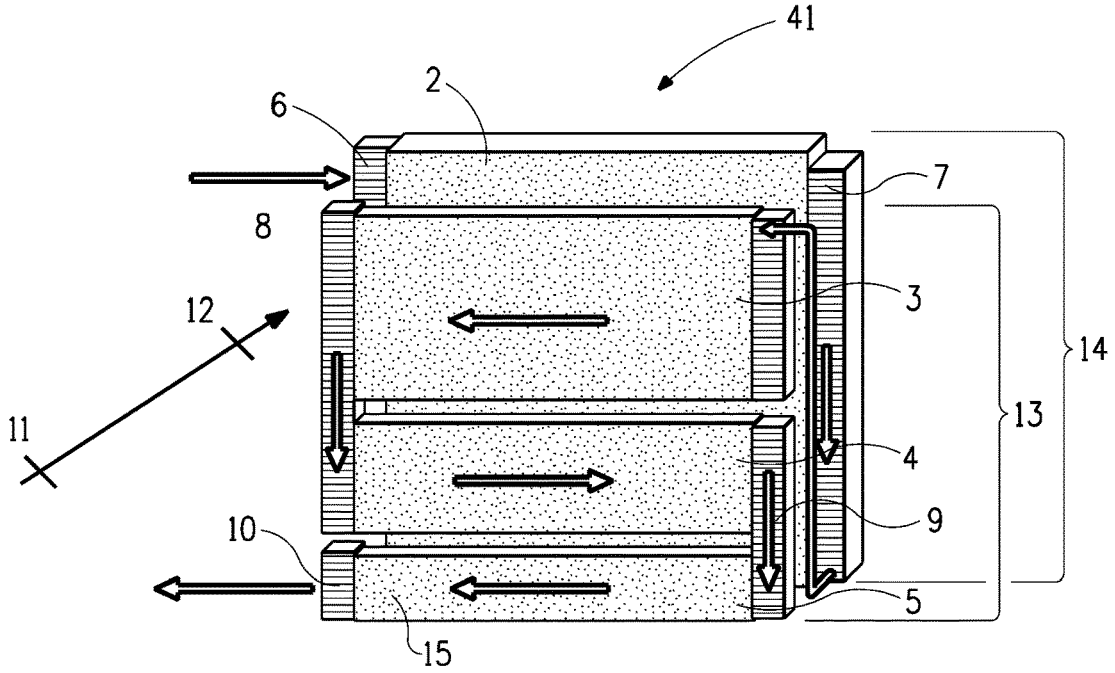
FIG. 2 is a perspective view of a dual-row condenser which can be used with the vapor compression heat transfer system of FIG. 1.

Reference will be made to FIG. 2 to describe such a system which includes a dual-row condenser. A dual-row condenser is shown at 41 in FIG. 2. In this dual-row cross-current/counter-current design, a hot working fluid enters the condenser through a first, or back row 14, passes through the first row, and exits the condenser through a second, or front row 13. The working fluid enters first row 14 via a collector 6 inside a first pass 2 of the first row. In the first, or back row, the working fluid is cooled in a counter current manner by air, which has been heated by the second, or front row 13 of this dual-row condenser. The working fluid goes from first pass 2 of the first row 14, to a pass 3 of the second, or front row 13 by a connection 7. The working fluid then flows from pass 3 to a pass 4 in second row 13 through a connection 8, and then flows from pass 4 to a pass 5 through a connection 9. Then the sub-cooled working fluid exits the condenser by a connection 10. Air is circulated in a counter-current manner relative to the working fluid flow, as indicated by the arrow having points 11 and 12 of FIG. 2. The design shown in FIG. 2 is generic and can be used for any air-to-refrigerant condenser in stationary applications as well as in mobile applications.

Figure 3:
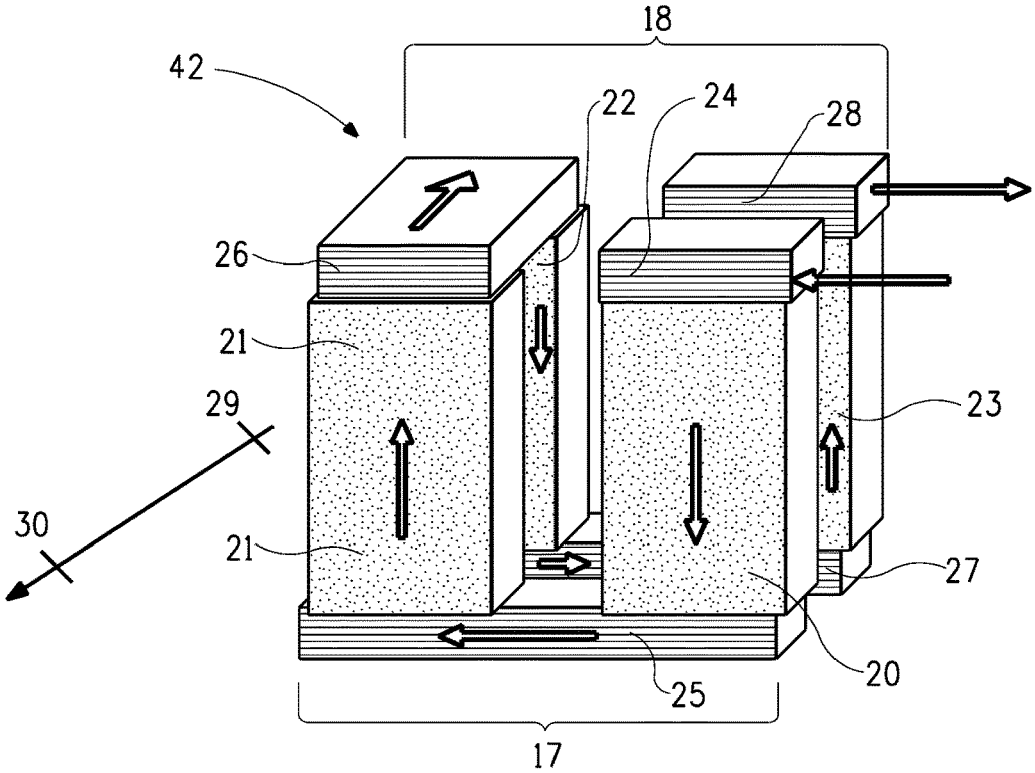
FIG. 3 is a perspective view of a dual-row evaporator used which can be used with the vapor compression heat transfer system of FIG. 1.

Reference will be made to FIG. 3 in describing a vapor compression heat transfer system comprising a dual-row evaporator. A dual-row evaporator is shown at 42 in FIG. 3. In this dual-row cross-current/counter-current design, working fluid enters the evaporator through a first, or front row 17, passes through the first row, and exits the condenser through a second, or back row 18. In particular, the working fluid enters the evaporator 19 at the lowest temperature through a collector 24 as shown in FIG. 3. Then the working fluid flows downwards through a tank 20 to a tank 21 through a collector 25, then from tank 21 to a tank 22 in the back row through a collector 26. The working fluid then flows from tank 22 to a tank 23 through a collector 27, and finally exits the evaporator through a collector 28. Air is circulated in a cross-countercurrent arrangement as indicated by the arrow having points 29 and 30, of FIG. 3.

In the embodiments as shown in FIGS. 1, 1A, 2 and 3, the connecting lines between the components of the vapor compression heat transfer system, through which the working fluid may flow, may be constructed of any typical conduit material known for such purpose. In one embodiment, metal piping or metal tubing (such as aluminum or copper or copper alloy tubing) may be used to connect the components of the heat transfer system. In another embodiment, hoses, constructed of various materials, such as polymers or elastomers, or combinations of such materials with reinforcing materials such as metal mesh etc., may be used in the system. One example of a hose design for heat transfer systems, in particular for automobile air conditioning systems, is provided in U.S. Provisional Patent Application No. 60/841,713, filed Sep. 1, 2006 (now International Application PCT/US07/019205 filed Aug. 31, 2007 and published as WO02008-027255A1 on Mar. 6, 2008). For the tubes of the IHX, metal piping or tubing provides more efficient transfer of heat from the hot liquid working fluid to the cold gaseous working fluid.

Various types of compressors may be used in the vapor compression heat transfer system of the embodiments of the present invention, including reciprocating, rotary, jet, centrifugal, scroll, screw or axial-flow, depending on the mechanical means to compress the fluid, or as positive-displacement (e.g., reciprocating, scroll or screw) or dynamic (e.g., centrifugal or jet).

In certain embodiments the heat transfer systems as disclosed herein may employ fin and tube heat exchangers, microchannel heat exchangers and vertical or horizontal single pass tube or plate type heat exchangers, among others for both the evaporator and condenser.

The closed loop vapor compression heat transfer system as described herein may be used in stationary refrigeration, air-conditioning, and heat pumps or mobile air-conditioning and refrigeration systems. Stationary air-conditioning and heat pump applications include window, ductless, ducted, packaged terminal, chillers and light commercial and commercial air-conditioning systems, including packaged rooftop. Refrigeration applications include domestic or home refrigerators and freezers, ice machines, self-contained coolers and freezers, walk-in coolers and freezers and supermarket systems, and transport refrigeration systems.

Mobile refrigeration or mobile air-conditioning systems refer to any refrigeration or air-conditioning system incorporated into a transportation unit for the road, rail, sea or air. In addition, apparatus, which are meant to provide refrigeration or air-conditioning for a system independent of any moving carrier, known as "intermodal" systems, are included in the present invention. Such intermodal systems include "containers" (combined sea/land transport) as well as "swap bodies" (combined road and rail transport). The present invention is particularly useful for road transport refrigerating or air-conditioning apparatus, such as automobile air-conditioning apparatus or refrigerated road transport equipment.

The working fluid utilized in the vapor compression heat transfer system comprises at least one fluoroolefin. By fluoroolefin is meant any compound containing carbon, fluorine and optionally, hydrogen or oxygen that also contains at least one double bond. These fluoroolefins may be linear, branched or cyclic.

Fluoroolefins have a variety of utilities in working fluids, which include use as foaming agents, blowing agents, fire extinguishing agents, heat transfer mediums (such as heat transfer fluids and refrigerants for use in refrigeration systems, refrigerators, air-conditioning systems, heat pumps, chillers, and the like), to name a few.

In some embodiments, heat transfer compositions may comprise fluoroolefins comprising at least one compound with 2 to 12 carbon atoms, in another embodiment the fluoroolefins comprise compounds with 3 to 10 carbon atoms, and in yet another embodiment the fluoroolefins comprise compounds with 3 to 7 carbon atoms. Representative fluoroolefins include but are not limited to all compounds as listed in Table 1, Table 2, and Table 3.

In one embodiment, the present methods use working fluids comprising fluoroolefins having the formula E- or $Z—R^1CH=CHR^2$ (Formula I), wherein $R^1$ and $R^2$ are, independently, $C_1$ to $C_6$ perfluoroalkyl groups. Examples of $R^1$ and $R^2$ groups include, but are not limited to, $CF_3$, $C_2F_5$, $CF_2CF_2CF_3$, $CF(CF_3)_2$, $CF_2CF_2CF_2CF_3$, $CF(CF_3)CF_2CF_3$, $CF_2CF(CF_3)_2$, $C(CF_3)_3$, $CF_2CF_2CF_2CF_2CF_3$, $CF_2CF_2CF(CF_3)_2$, $C(CF_3)_2C_2F_5$, $CF_2CF_2CF_2CF_2CF_2CF_3$, $CF(CF_3)CF_2CF_2C_2F_5$, and $C(CF_3)_2CF_2C_2F_5$. In one embodiment the fluoroolefins of Formula I, have at least about 4 carbon atoms in the molecule. In another embodiment, the fluoroolefins of Formula I have at least about 5 carbon atoms in the molecule. Exemplary, non-limiting Formula I compounds are presented in Table 1.

TABLE 1

| Code | Structure | Chemical Name |
|---|---|---|
| F11E | $CF_3CH=CHCF_3$ | 1,1,1,4,4,4-hexafluorobut-2-ene |
| F12E | $CF_3CH=CHC_2F_5$ | 1,1,1,4,4,5,5,5-octafluoropent-2-ene |
| F13E | $CF_3CH=CHCF_2C_2F_5$ | 1,1,1,4,4,5,5,6,6,6-decafluorohex-2-ene |
| F13iE | $CF_3CH=CHCF(CF_3)_2$ | 1,1,1,4,5,5,5-heptafluoro-4-(trifluoromethyl)pent-2-ene |
| F22E | $C_2F_5CH=CHC_2F_5$ | 1,1,1,2,2,5,5,6,6,6-decafluorohex-3-ene |
| F14E | $CF_3CH=CH(CF_2)_3CF_3$ | 1,1,1,4,4,5,5,6,6,7,7,7-dodecafluorohept-2-ene |
| F14iE | $CF_3CH=CHCF_2CF—(CF_3)_2$ | 1,1,1,4,4,5,6,6,6-nonafluoro-5-(trifluoromethyl)hex-2-ene |
| F14sE | $CF_3CH=CHCF(CF_3)—C_2F_5$ | 1,1,1,4,5,5,6,6,6-nonfluoro-4-(trifluoromethyl)hex-2-ene |
| F14tE | $CF_3CH=CHC(CF_3)_3$ | 1,1,1,5,5,5-hexafluoro-4,4-bis(trifluoromethyl)pent-2-ene |
| F23E | $C_2F_5CH=CHCF_2C_2F_5$ | 1,1,1,2,2,5,5,6,6,7,7,7-dodecafluorohept-3-ene |
| F23iE | $C_2F_5CH=CHCF(CF_3)_2$ | 1,1,1,2,2,5,6,6,6-nonafluoro-5-(trifluoromethyl)hex-3-ene |
| F15E | $CF_3CH=CH(CF_2)_4CF_3$ | 1,1,1,4,4,5,5,6,6,7,7,8,8,8-tetradecafluorooct-2-ene |
| F15iE | $CF_3CH=CH—CF_2CF_2CF(CF_3)_2$ | 1,1,1,4,4,5,5,6,7,7,7-undecafluoro-6-(trifluoromethyl)hept-2-ene |
| F15tE | $CF_3CH=CH—C(CF_3)_2C_2F_5$ | 1,1,1,5,5,6,6,6-octafluoro-4,4-bis(trifluoromethyl)hex-2-ene |
| F24E | $C_2F_5CH=CH(CF_2)_3CF_3$ | 1,1,1,2,2,5,5,6,6,7,7,8,8,8-tetradecafluorooct-3-ene |
| F24iE | $C_2F_5CH=CHCF_2CF—(CF_3)_2$ | 1,1,1,2,2,5,5,6,7,7,7-undecafluoro-6-(trifluoromethyl)hept-3-ene |
| F24sE | $C_2F_5CH=CHCF(CF_3)—C_2F_5$ | 1,1,1,2,2,5,6,6,7,7,7-undecafluoro-5-(trifluoromethyl)hept-3-ene |
| F24tE | $C_2F_5CH=CHC(CF_3)_3$ | 1,1,1,2,2,6,6,6-octafluoro-5,5-bis(trifluoromethyl)hex-3-ene |
| F33E | $C_2F_5CF_2CH=CH—CF_2C_2F_5$ | 1,1,1,2,2,3,3,6,6,7,7,8,8,8-tetradecafluorooct-4-ene |
| F3i3iE | $(CF_3)_2CFCH=CH—CF(CF_3)_2$ | 1,1,1,2,5,6,6,6-octafluoro-2,5-bis(trifluoromethyl)hex-3-ene |
| F33iE | $C_2F_5CF_2CH=CH—CF(CF_3)_2$ | 1,1,1,2,5,5,6,6,7,7,7-undecafluoro-2-(trifluoromethyl)hept-3-ene |
| F16E | $CF_3CH=CH(CF_2)_5CF_3$ | 1,1,1,4,4,5,5,6,6,7,7,8,8,,9,9,9-hexadecafluoronon-2-ene |
| F16sE | $CF_3CH=CHCF(CF_3)(CF_2)_2C_2F_5$ | 1,1,1,4,5,5,6,6,7,7,8,8,8-tridecafluoro-4-(trifluoromethyl)hept-2-ene |
| F16tE | $CF_3CH=CHC(CF_3)_2CF_2C_2F_5$ | 1,1,1,6,6,6-octafluoro-4,4-bis(trifluoromethyl)hept-2-ene |
| F25E | $C_2F_5CH=CH(CF_2)_4CF_3$ | 1,1,1,2,2,5,5,6,6,7,7,8,8,9,9,9-hexadecafluoronon-3-ene |
| F25iE | $C_2F_5CH=CH—CF_2CF_2CF(CF_3)_2$ | 1,1,1,2,2,5,5,6,6,7,8,8,8-tridecafluoro-7-(trifluoromethyl)oct-3-ene |
| F25tE | $C_2F_5CH=CH—C(CF_3)_2C_2F_5$ | 1,1,1,2,2,6,6,7,7,7-decafluoro-5,5-bis(trifluoromethyl)hept-3-ene |
| F34E | $C_2F_5CF_2CH=CH—(CF_2)_3CF_3$ | 1,1,1,2,2,3,3,6,6,7,7,8,8,9,9,9-hexadecafluoronon-4-ene |
| F34iE | $C_2F_5CF_2CH=CH—CF_2CF(CF_3)_2$ | 1,1,1,2,2,3,3,6,6,7,8,8,8-tridecafluoro-7-(trifluoromethyl)oct-4-ene |
| F34sE | $C_2F_5CF_2CH=CH—CF(CF_3)C_2F_5$ | 1,1,1,2,2,3,3,6,7,7,8,8,8-tridecafluoro-6-(trifluoromethyl)oct-4-ene |
| F34tE | $C_2F_5CF_2CH=CH—C(CF_3)_3$ | 1,1,1,5,5,6,6,7,7,7-decafluoro-2,2-bis(trifluoromethyl)hept-3-ene |
| F3i4E | $(CF_3)_2CFCH=CH—(CF_2)_3CF_3$ | 1,1,1,2,5,5,6,6,7,7,8,8,8-tridecafluoro-2(trifluoromethyl)oct-3-ene |
| F3i4iE | $(CF_3)_2CFCH=CH—CF_2CF(CF_3)_2$ | 1,1,1,2,5,5,6,7,7,7-decafluoro-2,6-bis(trifluoromethyl)hept-3-ene |

TABLE 1-continued

| Code | Structure | Chemical Name |
|---|---|---|
| F3i4sE | $(CF_3)_2CFCH{=}CH{-}CF(CF_3)C_2F_5$ | 1,1,1,2,5,6,6,7,7,7-decafluoro-2,5-bis(trifluoromethyl)hept-3-ene |
| F3i4tE | $(CF_3)_2CFCH{=}CH{-}C(CF_3)_3$ | 1,1,1,2,6,6,6-heptafluoro-2,5,5-tris(trifluoromethyl)hex-3-ene |
| F26E | $C_2F_5CH{=}CH(CF_2)_5CF_3$ | 1,1,1,2,2,5,5,6,6,7,7,8,8,9,9,10,10,10-octadecafluorodec-3-ene |
| F26sE | $C_2F_5CH{=}CHCF(CF_3)(CF_2)_2C_2F_5$ | 1,1,1,2,2,5,6,6,7,7,8,8,9,9,9-pentadecafluoro-5-(trifluoromethyl)non-3-ene |
| F26tE | $C_2F_5CH{=}CHC(CF_3)_2CF_2C_2F_5$ | 1,1,1,2,2,6,6,7,7,8,8,8-dodecafluoro-5,5-bis(trifluoromethyl)oct-3-ene |
| F35E | $C_2F_5CF_2CH{=}CH{-}(CF_2)_4CF_3$ | 1,1,1,2,2,3,3,6,6,7,7,8,8,9,9,10,10,10-octadecafluorodec-4-ene |
| F35iE | $C_2F_5CF_2CH{=}CH{-}CF_2CF_2CF(CF_3)_2$ | 1,1,1,2,2,3,3,6,6,7,7,8,9,9,9-pentadecafluoro-8-(trifluoromethyl)non-4-ene |
| F35tE | $C_2F_5CF_2CH{=}CH{-}C(CF_3)_2C_2F_5$ | 1,1,1,2,2,3,3,7,7,8,8,8-dodecafluoro-6,6-bis(trifluoromethyl)oct-4-ene |
| F3i5E | $(CF_3)_2CFCH{=}CH{-}(CF_2)_4CF_3$ | 1,1,1,2,5,5,6,6,7,7,8,8,9,9,9-pentadecafluoro-2-(trifluoromethyl)non-3-ene |
| F3i5iE | $(CF_3)_2CFCH{=}CH{-}CF_2CF_2CF(CF_3)_2$ | 1,1,1,2,5,5,6,6,7,8,8,8-dodecafluoro-2,7-bis(trifluoromethyl)oct-3-ene |
| F3i5tE | $(CF_3)_2CFCH{=}CH{-}C(CF_3)_2C_2F_5$ | 1,1,1,2,6,6,7,7,7-nonafluoro-2,5,5-tris(trifluoromethyl)hept-3-ene |
| F44E | $CF_3(CF_2)_3CH{=}CH{-}(CF_2)_3CF_3$ | 1,1,1,2,2,3,3,4,4,7,7,8,8,9,9,10,10,10-octadecafluorodec-5-ene |
| F44iE | $CF_3(CF_2)_3CH{=}CH{-}CF_2CF(CF_3)_2$ | 1,1,1,2,3,3,6,6,7,7,8,8,9,9,9-pentadecafluoro-2-(trifluoromethyl)non-4-ene |
| F44sE | $CF_3(CF_2)_3CH{=}CH{-}CF(CF_3)C_2F_5$ | 1,1,1,2,2,3,6,6,7,7,8,8,9,9,9-pentadecafluoro-3-(trifluoromethyl)non-4-ene |
| F44tE | $CF_3(CF_2)_3CH{=}CH{-}C(CF_3)_3$ | 1,1,1,5,5,6,6,7,7,8,8,8-dodecafluoro-2,2,-bis(trifluoromethyl)oct-3-ene |
| F4i4iE | $(CF_3)_2CFCF_2CH{=}CH{-}CF_2CF(CF_3)_2$ | 1,1,1,2,3,3,6,6,7,8,8,8-dodecafluoro-2,7-bis(trifluoromethyl)oct-4-ene |
| F4i4sE | $(CF_3)_2CFCF_2CH{=}CH{-}CF(CF_3)C_2F_5$ | 1,1,1,2,3,3,6,7,7,8,8,8-dodecafluoro-2,6-bis(trifluoromethyl)oct-4-ene |
| F4i4tE | $(CF_3)_2CFCF_2CH{=}CH{-}C(CF_3)_3$ | 1,1,1,5,5,6,7,7,7-nonafluoro-2,2,6-tris(trifluoromethyl)hept-3-ene |
| F4s4sE | $C_2F_5CF(CF_3)CH{=}CH{-}CF(CF_3)C_2F_5$ | 1,1,1,2,2,3,6,7,7,8,8,8-dodecafluoro-3,6-bis(trifluoromethyl)oct-4-ene |
| F4s4tE | $C_2F_5CF(CF_3)CH{=}CH{-}C(CF_3)_3$ | 1,1,1,5,6,6,7,7,7-nonafluoro-2,2,5-tris(trifluoromethyl)hept-3-ene |
| F4t4tE | $(CF_3)_3CCH{=}CH{-}C(CF_3)_3$ | 1,1,1,6,6,6-hexafluoro-2,2,5,5-tetrakis(trifluoromethyl)hex-3-ene |

Compounds of Formula I may be prepared by contacting a perfluoroalkyl iodide of the formula $R^1I$ with a perfluoroalkyltrihydroolefin of the formula $R^2CH{=}CH_2$ to form a trihydroiodoperfluoroalkane of the formula $R^1CH_2CHIR^2$. This trihydroiodoperfluoroalkane can then be dehydroiodinated to form $R^1CH{=}CHR^2$. Alternatively, the olefin $R^1CH{=}CHR^2$ may be prepared by dehydroiodination of a trihydroiodoperfluoroalkane of the formula $R^1CHICH_2R^2$ formed in turn by reacting a perfluoroalkyl iodide of the formula $R^2I$ with a perfluoroalkyltrihydroolefin of the formula $R^1CH{=}CH_2$.

Said contacting of a perfluoroalkyl iodide with a perfluoroalkyltrihydroolefin may take place in batch mode by combining the reactants in a suitable reaction vessel capable of operating under the autogenous pressure of the reactants and products at reaction temperature. Suitable reaction vessels include fabricated from stainless steels, in particular of the austenitic type, and the well-known high nickel alloys such as Monel® nickel-copper alloys, Hastelloy® nickel based alloys and Inconel® nickel-chromium alloys.

Alternatively, the reaction may take be conducted in semi-batch mode in which the perfluoroalkyltrihydroolefin reactant is added to the perfluoroalkyl iodide reactant by means of a suitable addition apparatus such as a pump at the reaction temperature.

The ratio of perfluoroalkyl iodide to perfluoroalkyltrihydroolefin should be between about 1:1 to about 4:1, preferably from about 1.5:1 to 2.5:1. Ratios less than 1.5:1 tend to result in large amounts of the 2:1 adduct as reported by Jeanneaux, et. al. in *Journal of Fluorine Chemistry*, Vol. 4, pages 261-270 (1974).

Preferred temperatures for contacting of said perfluoroalkyl iodide with said perfluoroalkyltrihydroolefin are preferably within the range of about 150° C. to 300° C., preferably from about 170° C. to about 250° C., and most preferably from about 180° C. to about 230° C.

Suitable contact times for the reaction of the perfluoroalkyl iodide with the perfluoroalkyltrihydroolefin are from about 0.5 hour to 18 hours, preferably from about 4 to about 12 hours.

The trihydroiodoperfluoroalkane prepared by reaction of the perfluoroalkyl iodide with the perfluoroalkyltrihydroolefin may be used directly in the dehydroiodination step or may preferably be recovered and purified by distillation prior to the dehydroiodination step.

The dehydroiodination step is carried out by contacting the trihydroiodoperfluoroalkane with a basic substance. Suitable basic substances include alkali metal hydroxides (e.g., sodium hydroxide or potassium hydroxide), alkali metal oxide (for example, sodium oxide), alkaline earth metal hydroxides (e.g., calcium hydroxide), alkaline earth metal oxides (e.g., calcium oxide), alkali metal alkoxides (e.g., sodium methoxide or sodium ethoxide), aqueous ammonia, sodium amide, or mixtures of basic substances such as soda lime. Preferred basic substances are sodium hydroxide and potassium hydroxide.

Said contacting of the trihydroiodoperfluoroalkane with a basic substance may take place in the liquid phase preferably in the presence of a solvent capable of dissolving at least a portion of both reactants. Solvents suitable for the dehydroiodination step include one or more polar organic solvents such as alcohols (e.g., methanol, ethanol, n-propanol, isopropanol, n-butanol, isobutanol, and tertiary butanol), nitriles (e.g., acetonitrile, propionitrile, butyronitrile, benzonitrile, or adiponitrile), dimethyl sulfoxide, N,N-dimethylformamide, N,N-dimethylacetamide, or sulfolane. The choice of solvent may depend on the boiling point product and the ease of separation of traces of the solvent from the product during purification. Typically, ethanol or isopropanol are good solvents for the reaction.

Typically, the dehydroiodination reaction may be carried out by addition of one of the reactants (either the basic substance or the trihydroiodoperfluoroalkane) to the other reactant in a suitable reaction vessel. Said reaction may be fabricated from glass, ceramic, or metal and is preferably agitated with an impeller or stirring mechanism.

Temperatures suitable for the dehydroiodination reaction are from about 10° C. to about 100° C., preferably from about 200° C. to about 70° C. The dehydroiodination reaction may be carried out at ambient pressure or at reduced or elevated pressure. Of note are dehydroiodination reactions in which the compound of Formula I is distilled out of the reaction vessel as it is formed.

Alternatively, the dehydroiodination reaction may be conducted by contacting an aqueous solution of said basic substance with a solution of the trihydroiodoperfluoroalkane in one or more organic solvents of lower polarity such as an alkane (e.g., hexane, heptane, or octane), aromatic hydrocarbon (e.g., toluene), halogenated hydrocarbon (e.g., methylene chloride, chloroform, carbon tetrachloride, or perchloroethylene), or ether (e.g., diethyl ether, methyl tert-butyl ether, tetrahydrofuran, 2-methyl tetrahydrofuran, dioxane, dimethoxyethane, diglyme, or tetraglyme) in the presence of a phase transfer catalyst. Suitable phase transfer catalysts include quaternary ammonium halides (e.g., tetrabutylammonium bromide, tetrabutylammonium hydrosulfate, triethylbenzylammonium chloride, dodecyltrimethylammonium chloride, and tricaprylylmethylammonium chloride), quaternary phosphonium halides (e.g., triphenylmethylphosphonium bromide and tetraphenylphosphonium chloride), or cyclic polyether compounds known in the art as crown ethers (e.g., 18-crown-6 and 15-crown-5).

Alternatively, the dehydroiodination reaction may be conducted in the absence of solvent by adding the trihydroiodoperfluoroalkane to a solid or liquid basic substance.

Suitable reaction times for the dehydroiodination reactions are from about 15 minutes to about six hours or more depending on the solubility of the reactants. Typically the dehydroiodination reaction is rapid and requires about 30 minutes to about three hours for completion. The compound of formula I may be recovered from the dehydroiodination reaction mixture by phase separation after addition of water, by distillation, or by a combination thereof.

In another embodiment of the present invention, fluoroolefins comprise cyclic fluoroolefins (cyclo-[CX═CY(CZW)$_n$—] (Formula II), wherein X, Y, Z, and W are independently selected from H and F, and n is an integer from 2 to 5). In one embodiment the fluoroolefins of Formula II, have at least about 3 carbon atoms in the molecule. In another embodiment, the fluoroolefins of Formula II have at least about 4 carbon atoms in the molecule. In yet another embodiment, the fluoroolefins of Formula II have at least about 5 carbon atoms in the molecule. Representative cyclic fluoroolefins of Formula II are listed in Table 2.

TABLE 2

| Cyclic fluoroolefins | Structure | Chemical name |
|---|---|---|
| FC-C1316cc | cyclo-$CF_2CF_2CF{=}CF$— | 1,2,3,3,4,4-hexafluorocyclobutene |
| HFC-C1334cc | cyclo-$CF_2CF_2CH{=}CH$— | 3,3,4,4-tetrafluorocyclobutene |
| HFC-C1436 | cyclo-$CF_2CF_2CF_2CH{=}CH$— | 3,3,4,4,5,5,-hexafluorocyclopentene |
| FC-C1418y | cyclo-$CF_2CF{=}CFCF_2CF_2$— | 1,2,3,3,4,4,5,5-octafluorocyclopentene |
| FC-C151-10y | cyclo-$CF_2CF{=}CFCF_2CF_2CF_2$— | 1,2,3,3,4,4,5,5,6,6-decafluorocyclohexene |

The compositions of the present invention may comprise a single compound of Formula I or formula II, for example, one of the compounds in Table 1 or Table 2, or may comprise a combination of compounds of Formula I or formula II.

In another embodiment, fluoroolefins may comprise those compounds listed in Table 3.

TABLE 3

| Name | Structure | Chemical name |
|---|---|---|
| HFC-1225ye | $CF_3CF{=}CHF$ | 1,2,3,3,3-pentafluoro-1-propene |
| HFC-1225zc | $CF_3CH{=}CF_2$ | 1,1,3,3,3-pentafluoro-1-propene |
| HFC-1225yc | $CHF_2CF{=}CF_2$ | 1,1,2,3,3-pentafluoro-1-propene |
| HFC-1234ye | $CHF_2CF{=}CHF$ | 1,2,3,3-tetrafluoro-1-propene |
| HFC-1234yf | $CF_3CF{=}CH_2$ | 2,3,3,3-tetrafluoro-1-propene |
| HFC-1234ze | $CF_3CH{=}CHF$ | 1,3,3,3-tetrafluoro-1-propene |
| HFC-1234yc | $CH_2FCF{=}CF_2$ | 1,1,2,3-tetrafluoro-1-propene |
| HFC-1234zc | $CHF_2CH{=}CF_2$ | 1,1,3,3-tetrafluoro-1-propene |
| HFC-1243yf | $CHF_2CF{=}CH_2$ | 2,3,3-trifluoro-1-propene |
| HFC-1243zf | $CF_3CH{=}CH_2$ | 3,3,3-trifluoro-1-propene |
| HFC-1243yc | $CH_3CF{=}CF_2$ | 1,1,2-trifluoro-1-propene |
| HFC-1243zc | $CH_2FCH{=}CF_2$ | 1,1,3-trifluoro-1-propene |
| HFC-1243ye | $CH_2FCF{=}CHF$ | 1,2,3-trifluoro-1-propene |
| HFC-1243ze | $CHF_2CH{=}CHF$ | 1,3,3-trifluoro-1-propene |
| FC-1318my | $CF_3CF{=}CFCF_3$ | 1,1,1,2,3,4,4,4-octafluoro-2-butene |
| FC-1318cy | $CF_3CF_2CF{=}CF_2$ | 1,1,2,3,3,4,4,4-octafluoro-1-butene |
| HFC-1327my | $CF_3CF{=}CHCF_3$ | 1,1,1,2,4,4,4-heptafluoro-2-butene |
| HFC-1327ye | $CHF{=}CFCF_2CF_3$ | 1,2,3,3,4,4,4-heptafluoro-1-butene |
| HFC-1327py | $CHF_2CF{=}CFCF_3$ | 1,1,1,2,3,4,4-heptafluoro-2-butene |
| HFC-1327et | $(CF_3)_2C{=}CHF$ | 1,3,3,3-tetrafluoro-2-(trifluoromethyl)-1-propene |
| HFC-1327cz | $CF_2{=}CHCF_2CF_3$ | 1,1,3,3,4,4,4-heptafluoro-1-butene |
| HFC-1327cye | $CF_2{=}CFCHFCF_3$ | 1,1,2,3,4,4,4-heptafluoro-1-butene |
| HFC-1327cyc | $CF_2{=}CFCF_2CHF_2$ | 1,1,2,3,3,4,4-heptafluoro-1-butene |
| HFC-1336yf | $CF_3CF_2CF{=}CH_2$ | 2,3,3,4,4,4-hexafluoro-1-butene |
| HFC-1336ze | $CHF{=}CHCF_2CF_3$ | 1,3,3,4,4,4-hexafluoro-1-butene |
| HFC-1336eye | $CHF{=}CFCHFCF_3$ | 1,2,3,4,4,4-hexafluoro-1-butene |
| HFC-1336eyc | $CHF{=}CFCF_2CHF_2$ | 1,2,3,3,4,4-hexafluoro-1-butene |
| HFC-1336pyy | $CHF_2CF{=}CFCHF_2$ | 1,1,2,3,4,4-hexafluoro-2-butene |
| HFC-1336qy | $CH_2FCF{=}CFCF_3$ | 1,1,1,2,3,4-hexafluoro-2-butene |
| HFC-1336pz | $CHF_2CH{=}CFCF_3$ | 1,1,1,2,4,4-hexafluoro-2-butene |
| HFC-1336mzy | $CF_3CH{=}CFCHF_2$ | 1,1,1,3,4,4-hexafluoro-2-butene |
| HFC-1336qc | $CF_2{=}CFCF_2CH_2F$ | 1,1,2,3,3,4-hexafluoro-1-butene |
| HFC-1336pe | $CF_2{=}CFCHFCHF_2$ | 1,1,2,3,4,4-hexafluoro-1-butene |
| HFC-1336ft | $CH_2{=}C(CF_3)_2$ | 3,3,3-trifluoro-2-(trifluoromethyl)-1-propene |
| HFC-1345qz | $CH_2FCH{=}CFCF_3$ | 1,1,1,2,4-pentafluoro-2-butene |
| HFC-1345mzy | $CF_3CH{=}CFCH_2F$ | 1,1,1,3,4-pentafluoro-2-butene |
| HFC-1345fz | $CF_3CF_2CH{=}CH_2$ | 3,3,4,4,4-pentafluoro-1-butene |
| HFC-1345mzz | $CHF_2CH{=}CHCF_3$ | 1,1,1,4,4-pentafluoro-2-butene |
| HFC-1345sy | $CH_3CF{=}CFCF_3$ | 1,1,1,2,3-pentafluoro-2-butene |
| HFC-1345fyc | $CH_2{=}CFCF_2CHF_2$ | 2,3,3,4,4-pentafluoro-1-butene |
| HFC-1345pyz | $CHF_2CF{=}CHCHF_2$ | 1,1,2,4,4-pentafluoro-2-butene |
| HFC-1345cyc | $CH_3CF_2CF{=}CF_2$ | 1,1,2,3,3-pentafluoro-1-butene |
| HFC-1345pyy | $CH_2FCF{=}CFCHF_2$ | 1,1,2,3,4-pentafluoro-2-butene |
| HFC-1345eyc | $CH_2FCF_2CF{=}CHF$ | 1,2,3,3,4-pentafluoro-1-butene |
| HFC-1345ctm | $CF_2{=}C(CF_3)(CH_3)$ | 1,1,3,3,3-pentafluoro-2-methyl-1-propene |
| HFC-1345ftp | $CH_2{=}C(CHF_2)(CF_3)$ | 2-(difluoromethyl)-3,3,3-trifluoro-1-propene |
| HFC1345fye | $CH_2{=}CFCHFCF_3$ | 2,3,4,4,4-pentafluoro-1-butene |
| HFC-1345eyf | $CHF{=}CFCH_2CF_3$ | 1,2,4,4,4-pentafluoro-1-butene |
| HFC-1345eze | $CHF{=}CHCHFCF_3$ | 1,3,4,4,4-pentafluoro-1-butene |
| HFC-1345ezc | $CHF{=}CHCF_2CHF_2$ | 1,3,3,4,4-pentafluoro-1-butene |
| HFC-1345eye | $CHF{=}CFCHFCHF_2$ | 1,2,3,4,4-pentafluoro-1-butene |
| HFC-1354fzc | $CH_2{=}CHCF_2CHF_2$ | 3,3,4,4-tetrafluoro-1-butene |
| HFC-1354ctp | $CF_2{=}C(CHF_2)(CH_3)$ | 1,1,3,3-tetrafluoro-2-methyl-1-propene |
| HFC-1354etm | $CHF{=}C(CF_3)(CH_3)$ | 1,3,3,3-tetrafluoro-2-methyl-1-propene |
| HFC-1354tfp | $CH_2{=}C(CHF_2)_2$ | 2-(difluoromethyl)-3,3-difluoro-1-propene |
| HFC-1354my | $CF_3CF{=}CHCH_3$ | 1,1,1,2-tetrafluoro-2-butene |
| HFC-1354mzy | $CH_3CF{=}CHCF_3$ | 1,1,1,3-tetrafluoro-2-butene |
| FC-141-10myy | $CF_3CF{=}CFCF_2CF_3$ | 1,1,1,2,3,4,4,5,5,5-decafluoro-2-pentene |
| FC-141-10cy | $CF_2{=}CFCF_2CF_2CF_3$ | 1,1,2,3,3,4,4,5,5,5-decafluoro-1-pentene |
| HFC-1429mzt | $(CF_3)_2C{=}CHCF_3$ | 1,1,1,4,4,4-hexafluoro-2-(trifluoromethyl)-2-butene |
| HFC-1429myz | $CF_3CF{=}CHCF_2CF_3$ | 1,1,1,2,4,4,5,5,5-nonafluoro-2-pentene |
| HFC-1429mzy | $CF_3CH{=}CFCF_2CF_3$ | 1,1,1,3,4,4,5,5,5-nonafluoro-2-pentene |
| HFC-1429eyc | $CHF{=}CFCF_2CF_2CF_3$ | 1,2,3,3,4,4,5,5,5-nonafluoro-1-pentene |
| HFC-1429czc | $CF_2{=}CHCF_2CF_2CF_3$ | 1,1,3,3,4,4,5,5,5-nonafluoro-1-pentene |
| HFC-1429cycc | $CF_2{=}CFCF_2CF_2CHF_2$ | 1,1,2,3,3,4,4,5,5-nonafluoro-1-pentene |
| HFC-1429pyy | $CHF_2CF{=}CFCF_2CF_3$ | 1,1,2,3,4,4,5,5,5-nonafluoro-2-pentene |
| HFC-1429myyc | $CF_3CF{=}CFCF_2CHF_2$ | 1,1,1,2,3,4,4,5,5-nonafluoro-2-pentene |
| HFC-1429myye | $CF_3CF{=}CFCHFCF_3$ | 1,1,1,2,3,4,5,5,5-nonafluoro-2-pentene |
| HFC-1429eyym | $CHF{=}CFCF(CF_3)_2$ | 1,2,3,4,4,4-hexafluoro-3-(trifluoromethyl)-1-butene |
| HFC-1429cyzm | $CF_2{=}CFCH(CF_3)_2$ | 1,1,2,4,4,4-hexafluoro-3-(trifluoromethyl)-1-butene |
| HFC-1429mzt | $CF_3CH{=}C(CF_3)_2$ | 1,1,1,4,4,4-hexafluoro-2-(trifluoromethyl)-2-butene |
| HFC-1429czym | $CF_2{=}CHCF(CF_3)_2$ | 1,1,3,4,4,4-hexafluoro-3-(trifluoromethyl)-1-butene |

TABLE 3-continued

| Name | Structure | Chemical name |
|---|---|---|
| HFC-1438fy | $CH_2{=}CFCF_2CF_2CF_3$ | 2,3,3,4,4,5,5,5-octafluoro-1-pentene |
| HFC-1438eycc | $CHF{=}CFCF_2CF_2CHF_2$ | 1,2,3,3,4,4,5,5-octafluoro-1-pentene |
| HFC-1438ftmc | $CH_2{=}C(CF_3)CF_2CF_3$ | 3,3,4,4,4-pentafluoro-2-(trifluoromethyl)-1-butene |
| HFC-1438czzm | $CF_2{=}CHCH(CF_3)_2$ | 1,1,4,4,4-pentafluoro-3-(trifluoromethyl)-1-butene |
| HFC-1438ezym | $CHF{=}CHCF(CF_3)_2$ | 1,3,4,4,4-pentafluoro-3-(trifluoromethyl)-1-butene |
| HFC-1438ctmf | $CF_2{=}C(CF_3)CH_2CF_3$ | 1,1,4,4,4-pentafluoro-2-(trifluoromethyl)-1-butene |
| HFC-1447fzy | $(CF_3)_2CFCH{=}CH_2$ | 3,4,4,4-tetrafluoro-3-(trifluoromethyl)-1-butene |
| HFC-1447fz | $CF_3CF_2CF_2CH{=}CH_2$ | 3,3,4,4,5,5,5-heptafluoro-1-pentene |
| HFC-1447fycc | $CH_2{=}CFCF_2CF_2CHF_2$ | 2,3,3,4,4,5,5-heptafluoro-1-pentene |
| HFC-1447czcf | $CF_2{=}CHCF_2CH_2CF_3$ | 1,1,3,3,5,5,5-heptafluoro-1-pentene |
| HFC-1447mytm | $CF_3CF{=}C(CF_3)(CH_3)$ | 1,1,1,2,4,4,4-heptafluoro-3-methyl-2-butene |
| HFC-1447fyz | $CH_2{=}CFCH(CF_3)_2$ | 2,4,4,4-tetrafluoro-3-(trifluoromethyl)-1-butene |
| HFC-1447ezz | $CHF{=}CHCH(CF_3)_2$ | 1,4,4,4-tetrafluoro-3-(trifluoromethyl)-1-butene |
| HFC-1447qzt | $CH_2FCH{=}C(CF_3)_2$ | 1,4,4,4-tetrafluoro-2-(trifluoromethyl)-2-butene |
| HFC-1447syt | $CH_3CF{=}C(CF_3)_2$ | 2,4,4,4-tetrafluoro-2-(trifluoromethyl)-2-butene |
| HFC-1456szt | $(CF_3)_2C{=}CHCH_3$ | 3-(trifluoromethyl)-4,4,4-trifluoro-2-butene |
| HFC-1456szy | $CF_3CF_2CF{=}CHCH_3$ | 3,4,4,5,5,5-hexafluoro-2-pentene |
| HFC-1456mstz | $CF_3C(CH_3){=}CHCF_3$ | 1,1,1,4,4,4-hexafluoro-2-methyl-2-butene |
| HFC-1456fzce | $CH_2{=}CHCF_2CHFCF_3$ | 3,3,4,5,5,5-hexafluoro-1-pentene |
| HFC-1456ftmf | $CH_2{=}C(CF_3)CH_2CF_3$ | 4,4,4-trifluoro-2-(trifluoromethyl)-1-butene |
| FC-151-12c | $CF_3(CF_2)_3CF{=}CF_2$ | 1,1,2,3,3,4,4,5,5,6,6,6-dodecafluoro-1-hexene (or perfluoro-1-hexene) |
| FC-151-12mcy | $CF_3CF_2CF{=}CFCF_2CF_3$ | 1,1,1,2,2,3,4,5,5,6,6,6-dodecafluoro-3-hexene (or perfluoro-3-hexene) |
| FC-151-12mmtt | $(CF_3)_2C{=}C(CF_3)_2$ | 1,1,1,4,4,4-hexafluoro-2,3-bis(trifluoromethyl)-2-butene |
| FC-151-12mmzz | $(CF_3)_2CFCF{=}CFCF_3$ | 1,1,1,2,3,4,5,5,5-nonafluoro-4-(trifluoromethyl)-2-pentene |
| HFC-152-11mmtz | $(CF_3)_2C{=}CHC_2F_5$ | 1,1,1,4,4,5,5,5-octafluoro-2-(trifluoromethyl)-2-pentene |
| HFC-152-11mmyyz | $(CF_3)_2CFCF{=}CHCF_3$ | 1,1,1,3,4,5,5,5-octafluoro-4-(trifluoromethyl)-2-pentene |
| PFBE (or HFC-1549fz) | $CF_3CF_2CF_2CF_2CH{=}CH_2$ | 3,3,4,4,5,5,6,6,6-nonafluoro-1-hexene (or perfluorobutylethylene) |
| HFC-1549fztmm | $CH_2{=}CHC(CF_3)_3$ | 4,4,4-trifluoro-3,3-bis(trifluoromethyl)-1-butene |
| HFC-1549mmtts | $(CF_3)_2C{=}C(CH_3)(CF_3)$ | 1,1,1,4,4,4-hexafluoro-3-methyl-2-(trifluoromethyl)-2-butene |
| HFC-1549fycz | $CH_2{=}CFCF_2CH(CF_3)_2$ | 2,3,3,5,5,5-hexafluoro-4-(trifluoromethyl)-1-pentene |
| HFC-1549myts | $CF_3CF{=}C(CH_3)CF_2CF_3$ | 1,1,1,2,4,4,5,5,5-nonafluoro-3-methyl-2-pentene |
| HFC-1549mzzz | $CF_3CH{=}CHCH(CF_3)_2$ | 1,1,1,5,5,5-hexafluoro-4-(trifluoromethyl)-2-pentene |
| HFC-1558szy | $CF_3CF_2CF_2CF{=}CHCH_3$ | 3,4,4,5,5,6,6,6-octafluoro-2-hexene |
| HFC-1558fzccc | $CH_2{=}CHCF_2CF_2CF_2CHF_2$ | 3,3,4,4,5,5,6,6-octafluoro-2-hexene |
| HFC-1558mmtzc | $(CF_3)_2C{=}CHCF_2CH_3$ | 1,1,1,4,4-pentafluoro-2-(trifluoromethyl)-2-pentene |
| HFC-1558ftmf | $CH_2{=}C(CF_3)CH_2C_2F_5$ | 4,4,5,5,5-pentafluoro-2-(trifluoromethyl)-1-pentene |
| HFC-1567fts | $CF_3CF_2CF_2C(CH_3){=}CH_2$ | 3,3,4,4,5,5,5-heptafluoro-2-methyl-1-pentene |
| HFC-1567szz | $CF_3CF_2CF_2CH{=}CHCH_3$ | 4,4,5,5,6,6,6-heptafluoro-2-hexene |
| HFC-1567fzfc | $CH_2{=}CHCH_2CF_2C_2F_5$ | 4,4,5,5,6,6,6-heptafluoro-1-hexene |
| HFC-1567sfyy | $CF_3CF_2CF{=}CFC_2H_5$ | 1,1,1,2,2,3,4-heptafluoro-3-hexene |
| HFC-1567fzfy | $CH_2{=}CHCH_2CF(CF_3)_2$ | 4,5,5,5-tetrafluoro-4-(trifluoromethyl)-1-pentene |
| HFC-1567myzzm | $CF_3CF{=}CHCH(CF_3)(CH_3)$ | 1,1,1,2,5,5,5-heptafluoro-4-methyl-2-pentene |
| HFC-1567mmtyf | $(CF_3)_2C{=}CFC_2H_5$ | 1,1,1,3-tetrafluoro-2-(trifluoromethyl)-2-pentene |
| FC-161-14myy | $CF_3CF{=}CFCF_2CF_2C_2F_5$ | 1,1,1,2,3,4,4,5,5,6,6,7,7,7-tetradecafluoro-2-heptene |
| FC-161-14mcyy | $CF_3CF_2CF{=}CFCF_2C_2F_5$ | 1,1,1,2,2,3,4,5,5,6,6,7,7,7-tetradecafluoro-2-heptene |
| HFC-162-13mzy | $CF_3CH{=}CFCF_2CF_2C_2F_5$ | 1,1,1,3,4,4,5,5,6,6,7,7,7-tridecafluoro-2-heptene |

TABLE 3-continued

| Name | Structure | Chemical name |
|---|---|---|
| HFC162-13myz | $CF_3CF{=}CHCF_2CF_2C_2F_5$ | 1,1,1,2,4,4,5,5,6,6,7,7,7-tridecafluoro-2-heptene |
| HFC-162-13mczy | $CF_3CF_2CH{=}CFCF_2C_2F_5$ | 1,1,1,2,2,4,5,5,6,6,7,7,7-tridecafluoro-3-heptene |
| HFC-162-13mcyz | $CF_3CF_2CF{=}CHCF_2C_2F_5$ | 1,1,1,2,2,3,5,5,6,6,7,7,7-tridecafluoro-3-heptene |
| PEVE | $CF_2{=}CFOCF_2CF_3$ | pentafluoroethyl trifluorovinyl ether |
| PMVE | $CF_2{=}CFOCF_3$ | trifluoromethyl trifluorovinyl ether |

The compounds listed in Table 2 and Table 3 are available commercially or may be prepared by processes known in the art or as described herein.

1,1,1,4,4-pentafluoro-2-butene may be prepared from 1,1,1,2,4,4-hexafluorobutane ($CHF_2CH_2CHFCF_3$) by dehydrofluorination over solid KOH in the vapor phase at room temperature. The synthesis of 1,1,1,2,4,4-hexafluorobutane is described in U.S. Pat. No. 6,066,768, incorporated herein by reference.

1,1,1,4,4,4-hexafluoro-2-butene may be prepared from 1,1,1,4,4,4-hexafluoro-2-iodobutane ($CF_3CHICH_2CF_3$) by reaction with KOH using a phase transfer catalyst at about 60° C. The synthesis of 1,1,1,4,4,4-hexafluoro-2-iodobutane may be carried out by reaction of perfluoromethyl iodide ($CF_3I$) and 3,3,3-trifluoropropene ($CF_3CH{=}CH_2$) at about 200° C. under autogenous pressure for about 8 hours.

3,4,4,5,5,5-hexafluoro-2-pentene may be prepared by dehydrofluorination of 1,1,1,2,2,3,3-heptafluoropentane ($CF_3CF_2CF_2CH_2CH_3$) using solid KOH or over a carbon catalyst at 200-300° C. 1,1,1,2,2,3,3-heptafluoropentane may be prepared by hydrogenation of 3,3,4,4,5,5,5-heptafluoro-1-pentene ($CF_3CF_2CF_2CH{=}CH_2$).

1,1,1,2,3,4-hexafluoro-2-butene may be prepared by dehydrofluorination of 1,1,1,2,3,3,4-heptafluorobutane ($CH_2FCF_2CHFCF_3$) using solid KOH.

1,1,1,2,4,4-hexafluoro-2-butene may be prepared by dehydrofluorination of 1,1,1,2,2,4,4-heptafluorobutane ($CHF_2CH_2CF_2CF_3$) using solid KOH.

1,1,1,3,4,4-hexafluoro2-butene may be prepared by dehydrofluorination of 1,1,1,3,3,4,4-heptafluorobutane ($CF_3CH_2CF_2CHF_2$) using solid KOH.

1,1,1,2,4-pentafluoro-2-butene may be prepared by dehydrofluorination of 1,1,1,2,2,3-hexafluorobutane ($CH_2FCH_2CF_2CF_3$) using solid KOH.

1,1,1,3,4-pentafluoro-2-butene may be prepared by dehydrofluorination of 1,1,1,3,3,4-hexafluorobutane ($CF_3CH_2CF_2CH_2F$) using solid KOH.

1,1,1,3-tetrafluoro-2-butene may be prepared by reacting 1,1,1,3,3-pentafluorobutane ($CF_3CH_2CF_2CH_3$) with aqueous KOH at 120° C.

1,1,1,4,4,5,5,5-octafluoro-2-pentene may be prepared from ($CF_3CHICH_2CF_2CF_3$) by reaction with KOH using a phase transfer catalyst at about 60° C. The synthesis of 4-iodo-1,1,1,2,2,5,5,5-octafluoropentane may be carried out by reaction of perfluoroethyliodide ($CF_3CF_2I$) and 3,3,3-trifluoropropene at about 200° C. under autogenous pressure for about 8 hours.

1,1,1,2,2,5,5,6,6,6-decafluoro-3-hexene may be prepared from 1,1,1,2,2,5,5,6,6,6-decafluoro-3-iodohexane ($CF_3CF_2CHICH_2CF_2CF_3$) by reaction with KOH using a phase transfer catalyst at about 60° C. The synthesis of 1,1,1,2,2,5,5,6,6,6-decafluoro-3-iodohexane may be carried out by reaction of perfluoroethyliodide ($CF_3CF_2I$) and 3,3,4,4,4-pentafluoro-1-butene ($CF_3CF_2CH{=}CH_2$) at about 200° C. under autogenous pressure for about 8 hours.

1,1,1,4,5,5,5-heptafluoro-4-(trifluoromethyl)-2-pentene may be prepared by the dehydrofluorination of 1,1,1,2,5,5,5-heptafluoro-4-iodo-2-(trifluoromethyl)-pentane ($CF_3CHICH_2CF(CF_3)_2$) with KOH in isopropanol. $CF_3CHICH_2CF(CF_3)_2$ is made from reaction of $(CF_3)_2CFI$ with $CF_3CH{=}CH_2$ at high temperature, such as about 200° C.

1,1,1,4,4,5,5,6,6,6-decafluoro-2-hexene may be prepared by the reaction of 1,1,1,4,4,4-hexafluoro-2-butene ($CF_3CH{=}CHCF_3$) with tetrafluoroethylene ($CF_2{=}CF_2$) and antimony pentafluoride ($SbF_5$).

2,3,3,4,4-pentafluoro-1-butene may be prepared by dehydrofluorination of 1,1,2,2,3,3-hexafluorobutane over fluorided alumina at elevated temperature.

2,3,3,4,4,5,5,5-ocatafluoro-1-pentene may be prepared by dehydroflurination of 2,2,3,3,4,4,5,5,5-nonafluoropentane over solid KOH. 1,2,3,3,4,4,5,5-octafluoro-1-pentene may be prepared by dehydrofluorination of 2,2,3,3,4,4,5,5,5-nonafluoropentane over fluorided alumina at elevated temperature.

Many of the compounds of Formula I, Formula II, Table 1, Table 2, and Table 3 exist as different configurational isomers or stereoisomers. When the specific isomer is not designated, the described composition is intended to include all single configurational isomers, single stereoisomers, or any combination thereof. For instance, F11E is meant to represent the E-isomer, Z-isomer, or any combination or mixture of both isomers in any ratio. As another example, HFC-1225ye is meant to represent the E-isomer, Z-isomer, or any combination or mixture of both isomers in any ratio, with the Z isomer preferred.

In some embodiments, the working fluid may further comprise at least one compound selected from hydrofluorocarbons, fluoroethers, hydrocarbons, dimethyl ether (DME), carbon dioxide ($CO_2$), ammonia ($NH_3$), and iodotrifluoromethane ($CF_3I$).

In some embodiments, the working fluid may further comprise hydrofluorocarbons comprising at least one saturated compound containing carbon, hydrogen, and fluorine. Of particular utility are hydrofluorocarbons having 1 to 7 carbon atoms and having a normal boiling point of from about −90° C. to about 80° C. Hydrofluorocarbons are commercial products available from a number of sources or may be prepared by methods known in the art. Representative hydrofluorocarbon compounds include but are not limited to fluoromethane ($CH_3F$, HFC-41), difluoromethane ($CH_2F_2$, HFC-32), trifluoromethane ($CHF_3$, HFC-23), pentafluoroethane ($CF_3CHF_2$, HFC-125), 1,1,2,2-tetrafluoroethane ($CHF_2CHF_2$, HFC-134), 1,1,1,2-tetrafluoroethane ($CF_3CH_2F$, HFC-134a), 1,1,1-trifluoroethane ($CF_3CH_3$, HFC-143a), 1,1-difluoroethane ($CHF_2CH_3$, HFC-152a), fluoroethane ($CH_3CH_2F$, HFC-161), 1,1,1,2,2,3,3-heptafluoropropane ($CF_3CF_2CHF_2$, HFC-227ca), 1,1,1,2,3,3,3-heptafluoropropane ($CF_3CHFCF_3$, HFC-227ea), 1,1,2,2,3,3-hexafluoropropane ($CHF_2CF_2CHF_2$, HFC-236ca), 1,1,1,2,2,3-hexafluoropropane ($CF_3CF_3CH_2F$, HFC-236cb), 1,1,1,2,3,3-hexafluoropropane ($CF_3CHFCHF_2$, HFC-236ea), 1,1,1,3,3,3-hexafluoropropane ($CF_3CH_2CF_3$, HFC-236fa), 1,1,2,2,3-pentafluoropropane ($CHF_2CF_2CH_2F$, HFC-245ca), 1,1,1,2,2-pentafluoropropane ($CF_3CF_2CH_3$, HFC-245cb), 1,1,2,3,3-pentafluoropropane ($CHF_2CHFCHF_2$, HFC-245ea), 1,1,1,2,3-pentafluoropropane ($CF_3CHFCH_2F$, HFC-245eb), 1,1,1,3,3-pentafluoropropane ($CF_3CH_2CHF_2$, HFC-245fa), 1,2,2,3-tetrafluoropropane ($CH_2FCF_2CH_2F$, HFC-254ca), 1,1,2,2-tetrafluoropropane ($CHF_2CF_2CH_3$, HFC-254cb), 1,1,2,3-tetrafluoropropane ($CHF_2CHFCH_2F$, HFC-254ea), 1,1,1,2-tetrafluoropropane ($CF_3CHFCH_3$, HFC-254eb), 1,1,3,3-tetrafluoropropane ($CHF_2CH_2CHF_2$, HFC-254fa), 1,1,1,3-tetrafluoropropane ($CF_3CH_2CH_2F$, HFC-254fb), 1,1,1-trifluoropropane ($CF_3CH_2CH_3$, HFC-263fb), 2,2-difluoropropane ($CH_3CF_2CH_3$, HFC-272ca), 1,2-difluoropropane ($CH_2FCHFCH_3$, HFC-272ea), 1,3-difluoropropane ($CH_2FCH_2CH_2F$, HFC-272fa), 1,1-difluoropropane ($CHF_2CH_2CH_3$, HFC-272fb), 2-fluoropropane ($CH_3CHFCH_3$, HFC-281ea), 1-fluoropropane ($CH_2FCH_2CH_3$, HFC-281fa), 1,1,2,2,3,3,4,4-octafluorobutane ($CHF_2CF_2CF_2CHF_2$, HFC-338pcc), 1,1,1,2,2,4,4,4-octafluorobutane ($CF_3CH_2CF_2CF_3$, HFC-338mf), 1,1,1,3,3-pentafluorobutane ($CF_3CH_2CHF_2$, HFC-365mfc), 1,1,1,2,3,4,4,5,5,5-decafluoropentane ($CF_3CHFCHFCF_2CF_3$, HFC-43-10mee), and 1,1,1,2,2,3,4,5,5,6,6,7,7,7-tetradecafluoroheptane ($CF_3CF_2CHFCHFCF_2CF_2CF_3$, HFC-63-14mee).

In some embodiments, working fluids may further comprise fluoroethers comprising at least one compound having carbon, fluorine, oxygen and optionally hydrogen, chlorine, bromine or iodine. Fluoroethers are commercially available or may be produced by methods known in the art. Representative fluoroethers include but are not limited to nonafluoromethoxybutane ($C_4F_9OCH_3$, any or all possible isomers or mixtures thereof); nonafluoroethoxybutane ($C_4F_9OC_2H_5$, any or all possible isomers or mixtures thereof); 2-difluoromethoxy-1,1,1,2-tetrafluoroethane (HFOC-236eaEβγ, or $CHF_2OCHFCF_3$); 1,1-difluoro-2-methoxyethane (HFOC-272fbEβγ, □$CH_3OCH_2CHF_2$); 1,1,1,3,3,3-hexafluoro-2-(fluoromethoxy)propane (HFOC-347mmzEβγ, or $CH_2FOCH(CF_3)_2$); 1,1,1,3,3,3-hexafluoro-2-methoxypropane (HFOC-356mmzEβγ, or $CH_3OCH(CH_3)_2$); 1,1,1,2,2-pentafluoro-3-methoxypropane (HFOC-365mcEγδ, or $CF_3CF_2CH_2OCH_3$); 2-ethoxy-1,1,1,2,3,3,3-heptafluoropropane (HFOC-467mmyEβγ, or $CH_3CH_2OCF(CF_3)_2$□; and mixtures thereof.

In some embodiments, working fluids may further comprise hydrocarbons comprising compounds having only carbon and hydrogen. Of particular utility are compounds having 3 to 7 carbon atoms. Hydrocarbons are commercially available through numerous chemical suppliers. Representative hydrocarbons include but are not limited to propane, n-butane, isobutane, cyclobutane, n-pentane, 2-methylbutane, 2,2-dimethylpropane, cyclopentane, n-hexane, 2-methylpentane, 2,2-dimethylbutane, 2,3-dimethylbutane, 3-methylpentane, cyclohexane, n-heptane, and cycloheptane.

In some embodiments, the working fluid may comprise hydrocarbons containing heteroatoms, such as dimethylether (DME, $CH_3OCH_3$). DME is commercially available.

In some embodiments, working fluids may further comprise carbon dioxide ($CO_2$), which is commercially available from various sources or may be prepared by methods known in the art.

In some embodiments, working fluids may further comprise ammonia ($NH_3$), which is commercially available from various sources or may be prepared by methods known in the art.

In some embodiments, the working fluid further comprises at least one compound selected from hydrofluorocarbons, fluoroethers, hydrocarbons, dimethyl ether (DME), carbon dioxide ($CO_2$), ammonia ($NH_3$), and iodotrifluoromethane ($CF_3I$).

In one embodiment, the working fluid comprises 1,2,3,3,3-pentafluoropropene (HFC-1225ye). In another embodiment, the working fluid further comprises difluoromethane (HFC-32). In yet another embodiment, the working fluid further comprises 1,1,1,2-tetrafluoroethane (HFC-134a).

In one embodiment, the working fluid comprises 2,3,3,3-tetrafluoropropene (HFC-1234yf). In another embodiment, the working fluid comprises HFC-1225ye and HFC-1234yf.

In one embodiment, the working fluid comprises 1,3,3,3-tetrafluoropropene (HFC-1234ze). In another embodiment, the working fluid comprises E-HFC-1234ze (or trans-HFC-1234ze).

In yet another embodiment, the working fluid further comprises at least one compound from the group consisting of HFC-134a, HFC-32, HFC-125, HFC-152a, and $CF_3I$.

In certain embodiments, working fluids may comprise a composition selected from the group consisting of:

HFC-32 and HFC-1225ye;
HFC-1234yf and $CF_3I$;
HFC-32, HFC-134a, and HFC-1225ye;
HFC-32, HFC-125, and HFC-1225ye;
HFC-32, HFC-1225ye, and HFC-1234yf;
HFC-125, HFC-1225ye, and HFC-1234yf;
HFC-32, HFC-1225ye, HFC-1234yf, and $CF_3I$;
HFC-134a, HFC-1225ye, and HFC-1234yf;
HFC-134a and HFC-1234yf;
HFC-32 and HFC-1234yf;
HFC-125 and HFC-1234yf;
HFC-32, HFC-125, and HFC-1234yf;
HFC-32, HFC-134a, and HFC-1234yf;
DME and HFC-1234yf;
HFC-152a and HFC-1234yf;
HFC-152a, HFC-134a, and HFC-1234yf;
HFC-152a, n-butane, and HFC-1234yf;
HFC-134a, propane, and HFC-1234yf;
HFC-125, HFC-152a, and HFC-1234yf;
HFC-125, HFC-134a, and HFC-1234yf;
HFC-32, HFC-1234ze, and HFC-1234yf;
HFC-125, HFC-1234ze, and HFC-1234yf;
HFC-32, HFC-1234ze, HFC-1234yf, and $CF_3I$;
HFC-134a, HFC-1234ze, and HFC-1234yf;
HFC-134a and HFC-1234ze;
HFC-32 and HFC-1234ze;
HFC-125 and HFC-1234ze;
HFC-32, HFC-125, and HFC-1234ze;
HFC-32, HFC-134a, and HFC-1234ze;
DME and HFC-1234ze;
HFC-152a and HFC-1234ze;
HFC-152a, HFC-134a, and HFC-1234ze;
HFC-152a, n-butane, and HFC-1234ze;
HFC-134a, propane, and HFC-1234ze;
HFC-125, HFC-152a, and HFC-1234ze; or
HFC-125, HFC-134a, and HFC-1234ze.

EXAMPLES

Example 1

Performance Comparison

Automobile air conditioning systems with and without an intermediate heat exchanger are tested to determine if an improvement is seen with the IHX. The working fluid is a blend of 95% by weight HFC-1225ye and 5% by weight of HFC-32. Each system has a condenser, evaporator, compressor and a thermal expansion device. The ambient air temperature is 30° C. at the evaporator and the condenser inlets. Tests are performed for 2 compressor speeds, 1000 and 2000 rpm, and for 3 vehicle speeds: 25, 30, and 36 km/h. The volumetric flow rate of air on the evaporator is 380 $m^3$/h.

The cooling capacity for the system with an IHX shows an increase of 4 to 7% as compared to the system with no IHX. The COP also shows an increase of 2.5 to 4% for the system with the IHX as compared to a system with no IHX.

Example 2

Improvement in Performance with Internal Heat Exchanger

Cooling performance is calculated for HFC-134a and HFC-1234yf both with and without an IHX. The conditions used are as follows:

| | |
|---|---|
| Condenser temperature | 55° C. |
| Evaporator temperature | 5° C. |
| Superheat (absolute) | 15° C. |

The data illustrating relative performance is shown in TABLE 5.

TABLE 5

| Test | Subcool, ° C. | COP | Capacity kJ/$m^3$ | Compressor work, kJ/kg |
|---|---|---|---|---|
| HFC-134a, without IHX | 0 | 4.74 | 2250.86 | 29.6 |
| HFC-134a, with IHX | 5.0 | 5.02 | 2381.34 | 29.6 |
| HFC-134a, % increase with IHX | | 5.91 | 5.80 | |
| HFC-1234yf, without IHX | 0 | 4.64 | 2172.43 | 24.37 |
| HFC-1234yf with IHX | 5.8 | 5.00 | 2335.38 | 24.37 |
| HFC-1234yf, % increase with IHX | | 7.76 | 7.50 | |

The data above demonstrate an unexpected level of improvement in energy efficiency (COP) and cooling capacity for the fluoroolefin (HFC-1234yf) with the IHX, as compared to that gained by HFC-134a with the IHX. In particular, COP is increased by 7.67% and cooling capacity is increased by 7.50%.

It should be noted that the subcool difference arises from the differences in molecular weight, liquid density and liquid heat capacity for HFC-1234yf as compared to HFC-134a. Based on these parameters it is estimated that there would be a difference in subcool achieved with the different compounds. When the HFC-134a subcool is set to 5° C., the corresponding subcool for HFC-1234yf is calculated to be 5.8° C.

What is claimed is:

1. A method for exchanging heat in a vapor compression heat transfer system of a mobile air-conditioning system having a working fluid circulating therethrough, comprising the steps of:

(a) circulating a working fluid comprising a fluoroolefin to an inlet of a first tube of an internal heat exchanger, through the internal heat exchanger and to an outlet thereof, wherein the fluoroolefin consists essentially of 2,3,3,3-tetrafluoro-1-propene;

(b) circulating the working fluid from the outlet of the first tube of the internal heat exchanger to an inlet of an evaporator, through the evaporator to evaporate the working fluid and convert it into a gas, and through an outlet of the evaporator;

(c) circulating the working fluid from the outlet of the evaporator to an inlet of a second tube of the internal heat exchanger to transfer heat from the liquid working fluid from a condenser to the gaseous working fluid from the evaporator, through the internal heat exchanger, and to an outlet of the second tube;

(d) circulating the working fluid from the outlet of the second tube of the internal heat exchanger to an inlet of a compressor, through the compressor to compress the working fluid gas, and to an outlet of the compressor;

(e) circulating the working fluid from the outlet of the compressor to an inlet of the condenser and through the condenser to condense the compressed working fluid gas into a liquid, and to an outlet of the condenser; wherein the working fluid exiting the condenser is subcooled, (f) circulating the subcooled working fluid from the outlet of the condenser to an inlet of the first tube of an intermediate heat exchanger to transfer heat from the liquid from the condenser to the gas from the evaporator, and to an outlet of the second tube; the intermediate heat exchanger, having the first tube with a larger diameter than the second tube, and the second tube is disposed concentrically in the first tube, and a hot liquid in the first tube surrounds a cool gas in the second tube; and (g) circulating the working fluid from the outlet of the second tube of the internal heat exchanger back to the evaporator; wherein the condensing step comprises:

(i) circulating the working fluid to and through a back row of a dual-row condenser in a first direction, where the back row receives the working fluid at a first temperature; and (ii) circulating the working fluid from the back row to a front row of the dual-row condenser configured for flow extending from and counter to the first direction, where the front row receives the working fluid at a second temperature, where the second temperature is less than the first temperature, so that air which travels across the front row and the back row is preheated, whereby the temperature of the air is greater when it reaches the back row than when it reaches the front row and wherein the evaporating comprises:

(iii) passing the working fluid through an inlet of a dual-row evaporator in a second direction, the dual-row evaporator having a first row and a second row, (ii) circulating the working fluid in the first row in third and fourth directions perpendicular to the flow direction of the working fluid through the inlet of the evaporator, and (iv) circulating the working fluid in the second row of the evaporator in a direction generally counter to the flow directions of the working fluid through the first row of the evaporator; and wherein the coefficient of performance and the cooling capacity of the system is increased by at least 7.5% and the compressor work is less than as compared to an equivalent system which uses HFC-134a as the working fluid.

2. The method of claim 1, where the working fluid in the second tube flows in a countercurrent direction to the direction of flow of the working fluid in the first tube, thereby cooling the working fluid in the first tube and heating the working fluid in the second tube.

3. The method of claim 1 wherein the first row of the condenser comprises a first inlet manifold and a plurality of channels for allowing a working fluid at a first temperature to flow into the manifold and then through the channels in at least one direction and collect in a second outlet manifold, (iii) a second row connected to the first row, the second-row comprising a plurality of channels for conducting a working fluid at a second temperature less than the refrigerant in the first row through the plurality of channels configured for the first and counter flow directions, (iv) conduit connecting the first row to the second row.

4. The method of claim 1 wherein the working fluid flow through the evaporator is perpendicular to the working fluid flow through the condenser.

5. The method of claim 1 wherein circulating the HFO-1234yf working fluid through the system contemporaneously increases performance and reduce compressor work.

6. A method for exchanging heat in a vapor compression heat transfer system of a mobile air-conditioning system having a working fluid circulating therethrough, comprising the steps of:

(a) circulating a working fluid comprising a fluoroolefin to an inlet of a first tube of an internal heat exchanger, through the internal heat exchanger and to an outlet thereof, wherein the fluoroolefin consists essentially of 2,3,3,3-tetrafluoropropene;

(b) circulating the working fluid from the outlet of the first tube of the internal heat exchanger to an inlet of an evaporator, through the evaporator to evaporate the working fluid and convert it into a gas, and through an outlet of the evaporator;

(c) circulating the working fluid from the outlet of the evaporator to an inlet of a second tube of the internal heat exchanger to transfer heat from the liquid working fluid from a condenser to the gaseous working fluid from the evaporator, through the internal heat exchanger, and to an outlet of the second tube;

(d) circulating the working fluid from the outlet of the second tube of the internal heat exchanger to an inlet of a compressor, through the compressor to compress the working fluid gas, and to an outlet of the compressor;

(e) circulating the working fluid from the outlet of the compressor to an inlet of the condenser in a first direction and through the condenser in both the first and counter direction to condense the compressed working fluid gas into a liquid, and to an outlet of the condenser wherein the working fluid exiting the condenser is subcooled, (f) circulating the subcooled working fluid from the outlet of the condenser to an inlet of the first tube of an intermediate heat exchanger to transfer heat from the liquid from the condenser to the gas from the evaporator, and to an outlet of the second tube where the working fluid in the second tube flows in a countercurrent direction to the direction of flow of the working fluid in the first tube, thereby cooling the working fluid in the first tube and heating the working fluid in the second tube and where the first tube has a larger diameter than the second tube, and the second tube is disposed concentrically in the first tube, and a hot liquid in the first tube surrounds a cool gas in the second tube; the intermediate heat exchanger having the first tube with a larger diameter than the second tube, and the second tube is disposed concentrically in the first tube, and a hot liquid in the first tube surrounds a cool gas in the second tube; and (g) circulating the working fluid from the outlet of the second tube of the internal heat exchanger back to the evaporator; wherein the evaporating step comprises:

(i) passing the working fluid through an inlet of a dual-row evaporator having a first row and a second row, (ii) circulating the working fluid in the first row in a direction perpendicular to the flow of the working fluid through the inlet of the evaporator, and (iii) circulating the working fluid in the second row in a direction generally counter to the direction of the flow of the working fluid through the second row of the evaporator inlet.

7. The method of claim 6, wherein the coefficient of performance and the cooling capacity of the system is increased by at least 7.5% and the compressor work is less than as compared to a system which uses HFC-134a as the working fluid.

8. The method of claim 6, wherein the condensing step comprises:

(i) circulating the working fluid to a back row of a dual-row condenser, where the back row receives the working fluid at a first temperature; and (ii) circulating the working fluid to a front row of the dual-row condenser, where the front row receives the working fluid at a second temperature, where the second temperature is less than the first temperature, so that air which travels across the front row and the back row is preheated, whereby the temperature of the air is greater when it reaches the back row than when it reaches the front row.

9. The method of claim 6 wherein the working fluid flow through the evaporator is generally perpendicular to the working fluid flow through the condenser.

10. The method of claim 6 wherein circulating the HFO-1234yf working fluid through the system contemporaneously increases performance and reduce compressor work.

* * * * *